US008279051B2

(12) United States Patent
Khan

(10) Patent No.: US 8,279,051 B2
(45) Date of Patent: Oct. 2, 2012

(54) REALTIME COACHING SYSTEM

(76) Inventor: Naser Mohammed Khan, Los Angeles, CA (US)

( * ) Notice: Subject to any disclaimer, the term of this patent is extended or adjusted under 35 U.S.C. 154(b) by 1127 days.

(21) Appl. No.: 12/082,793

(22) Filed: Apr. 14, 2008

(65) Prior Publication Data

US 2009/0256688 A1 Oct. 15, 2009

(51) Int. Cl.
*G08B 23/00* (2006.01)

(52) U.S. Cl. ..... 340/323 R; 340/539.13; 340/572.1; 342/357.57; 434/251; 434/257; 463/1; 463/42; 473/467; 700/91; 700/92; 707/758

(58) Field of Classification Search ..... 340/323 R, 340/539.13, 573.1, 572.1; 434/251, 257; 700/91, 92; 473/476, 415, 467; 463/1, 42; 342/357.57; 707/104.1, 758, 769
See application file for complete search history.

(56) References Cited

U.S. PATENT DOCUMENTS

| | | | | |
|---|---|---|---|---|
| 6,071,002 | A | 6/2000 | Katayama | |
| 6,204,813 | B1 * | 3/2001 | Wadell et al. | 342/463 |
| 7,005,970 | B2 * | 2/2006 | Hodsdon et al. | 340/323 R |
| 7,095,312 | B2 | 8/2006 | Erario et al. | |
| 2002/0143790 | A1 * | 10/2002 | Qian | 707/104.1 |
| 2007/0135243 | A1 * | 6/2007 | LaRue et al. | 473/467 |
| 2008/0140233 | A1 * | 6/2008 | Seacat | 700/91 |
| 2009/0111582 | A1 * | 4/2009 | Schuler et al. | 463/42 |
| 2009/0231198 | A1 * | 9/2009 | Walsh et al. | 342/463 |
| 2010/0283630 | A1 * | 11/2010 | Alonso | 340/870.11 |

* cited by examiner

*Primary Examiner* — Brent Swarthout
(74) *Attorney, Agent, or Firm* — Joseph K. Andonian

(57) ABSTRACT

A method and system for improving the effectiveness of coaches and video game designers for games like soccer, American football, basketball, lacrosse or ice hockey by using RF technology and software. A base station is equipped with a computer programmed with algorithms to track the players and game equipment and thereby produce data of interest to a coach or game designer.

5 Claims, 24 Drawing Sheets

| Player No. | Name | Statistics | | | | |
|---|---|---|---|---|---|---|
| | | Passes | Goals | Intercepts | Area Coverage | Saves |
| 1 | John, Smith | | | | | |
| 2 | Michael, Lee | | | | | |
| 3 | Sam, Johnson | | | | | |
| 4 | Kevin, S. | | | | | |
| 5 | Will, Harrods | | | | | |
| 6 | Tom, L. | | | | | |
| 7 | Jimmy (G) | | | | | |
| 8 | Karl, Mark | | | | | |
| 9 | Gerald | | | | | |
| 10 | Richard, T | | | | | |
| 11 | Paul, | | | | | |

| Plays | Name | Information | | | |
|---|---|---|---|---|---|
| | | Play Type | Players Req. | Ball Passes | Area Covered |
| 1 | Offence 1 | | | | |
| 2 | Defense 2 | | | | |
| 3 | Holding 5 | | | | |

Fig. 6
Fig. 6B
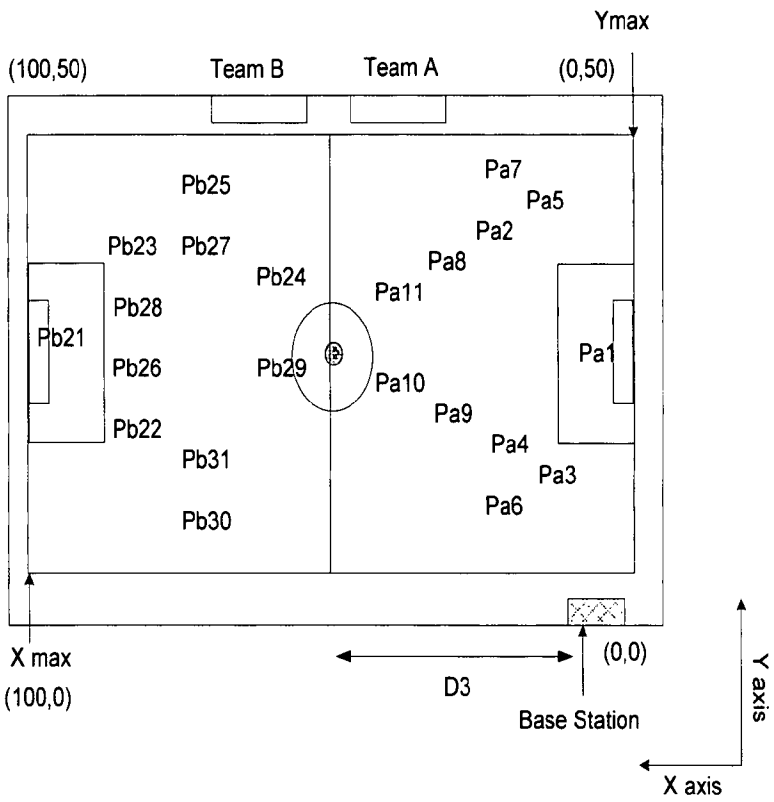
Fig. 6A
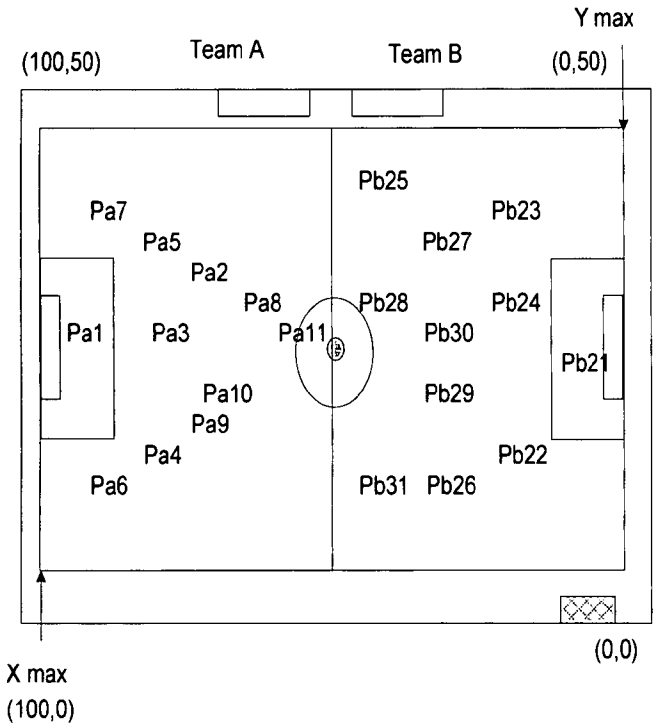

FIG.13A: INITIALLY BEFORE THE MATCH STARTS
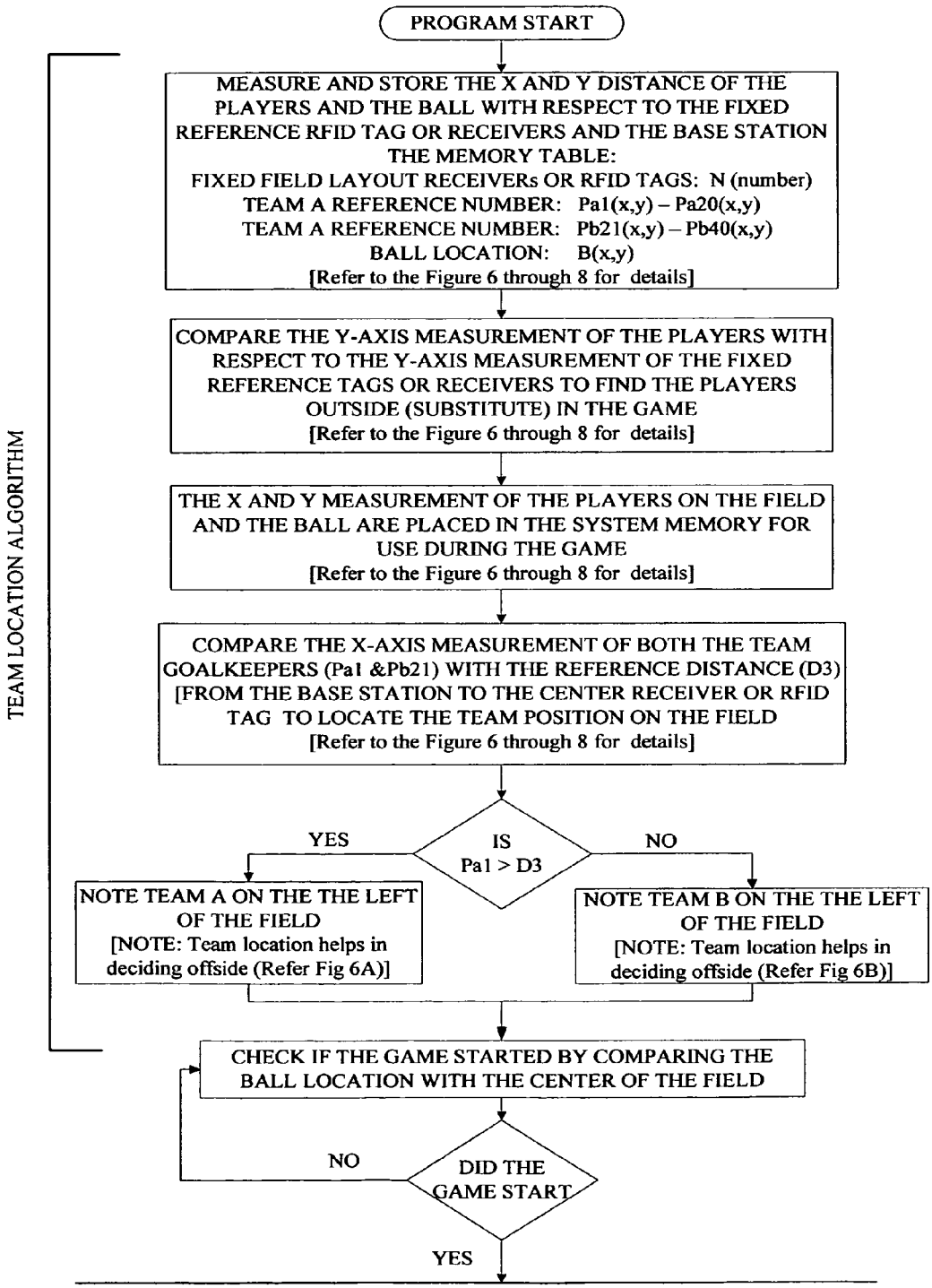

FIG.13B: DURING GAME PLAY
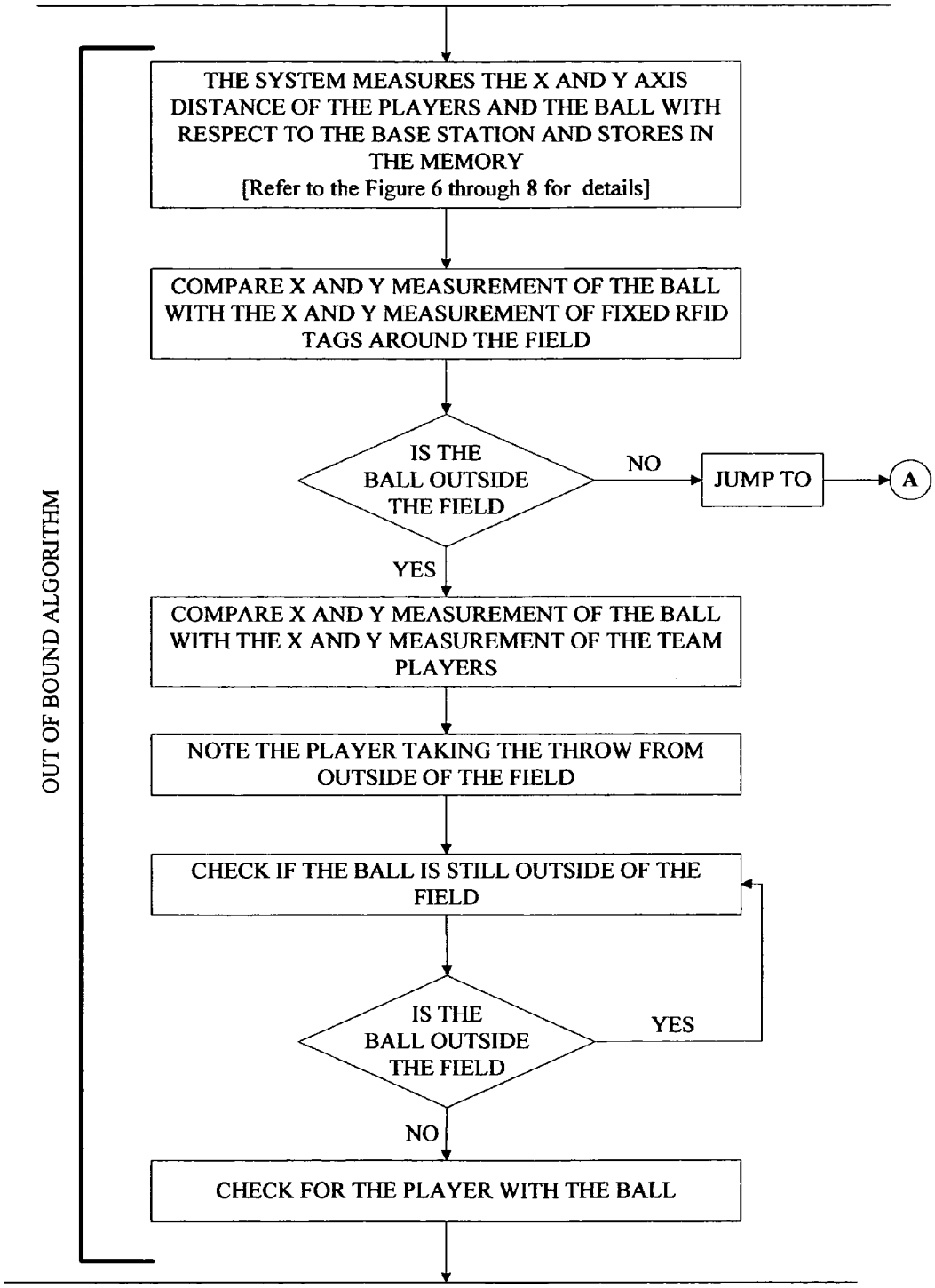

FIG.13C: GAME PLAY (CONT.)
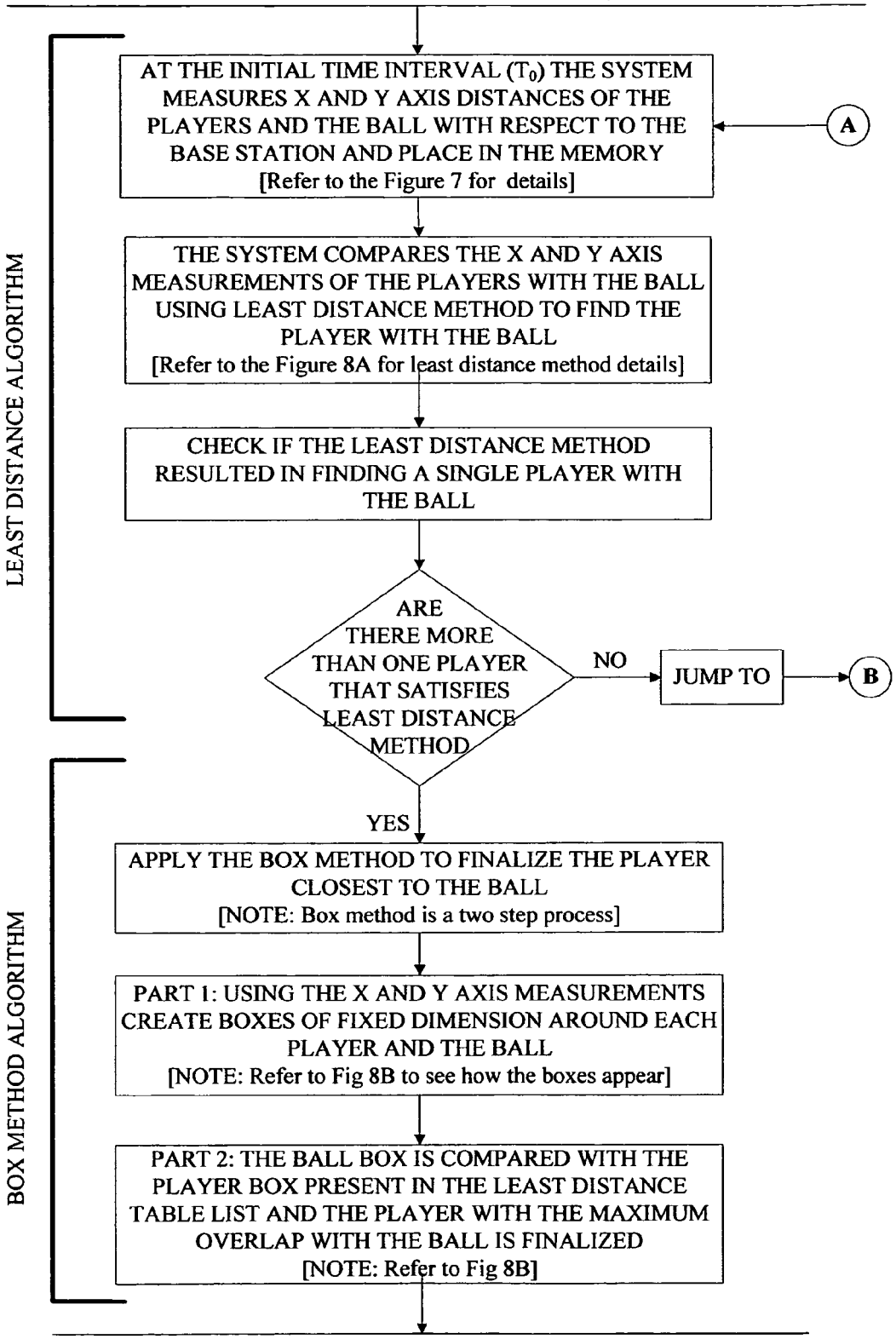

FIG.13D: GAME PLAY (END)
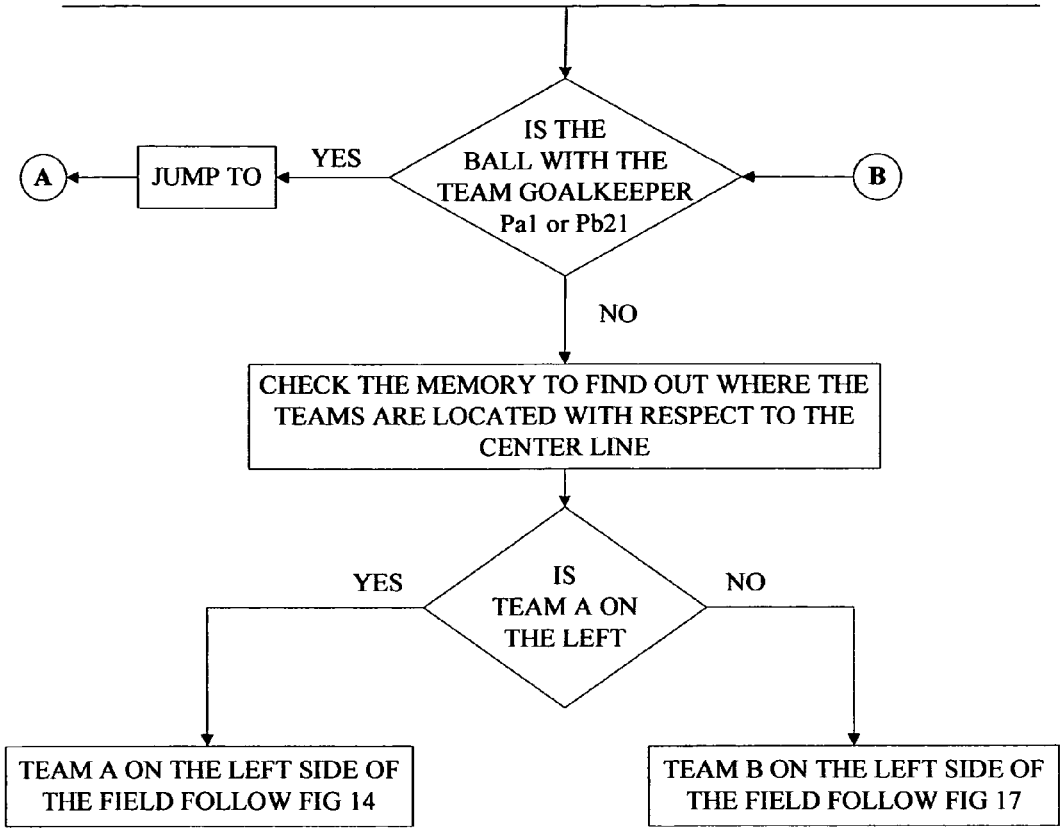

FIG 13E: GOAL DETECTION
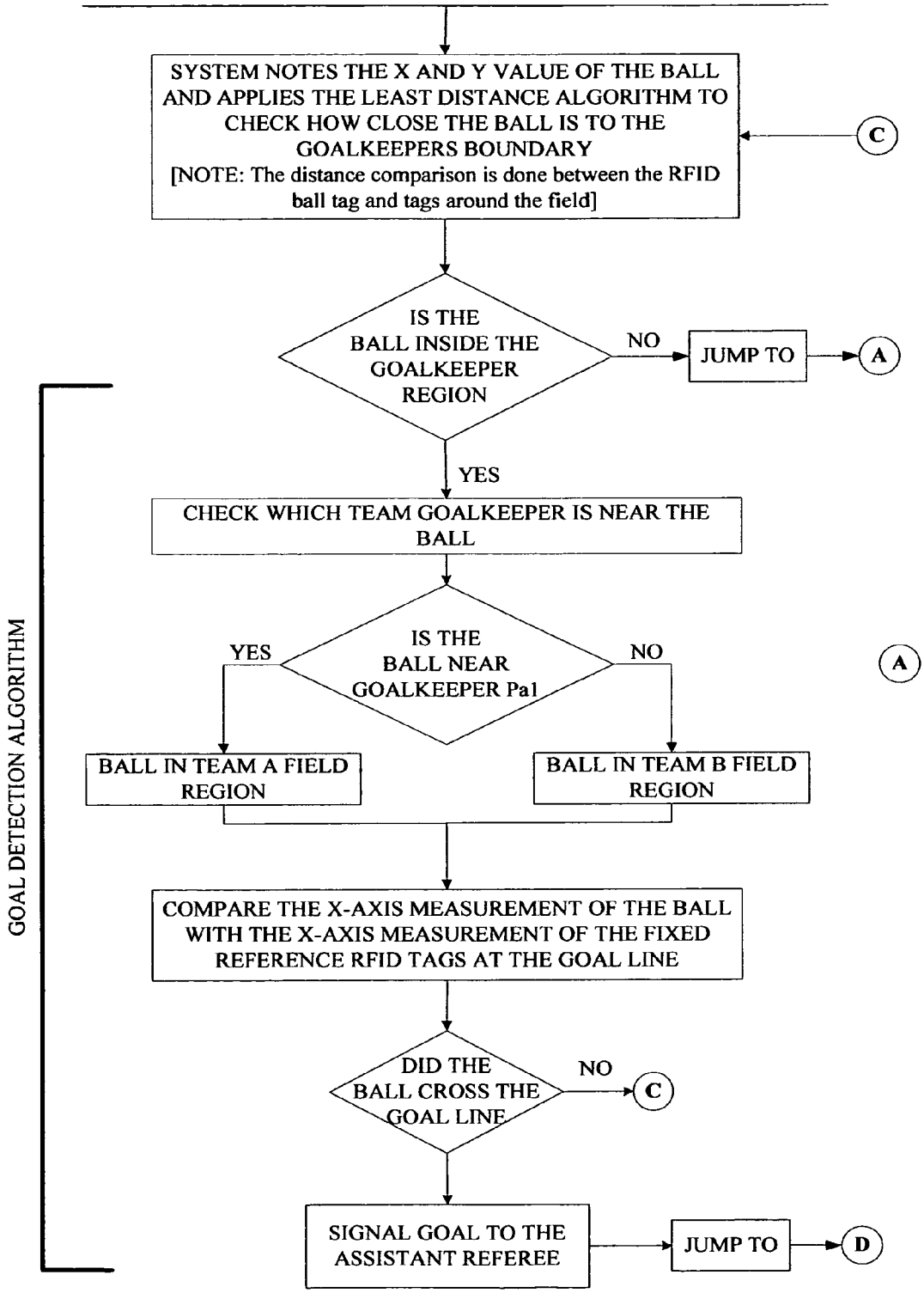

FIG.14: TEAM A ON THE LEFT
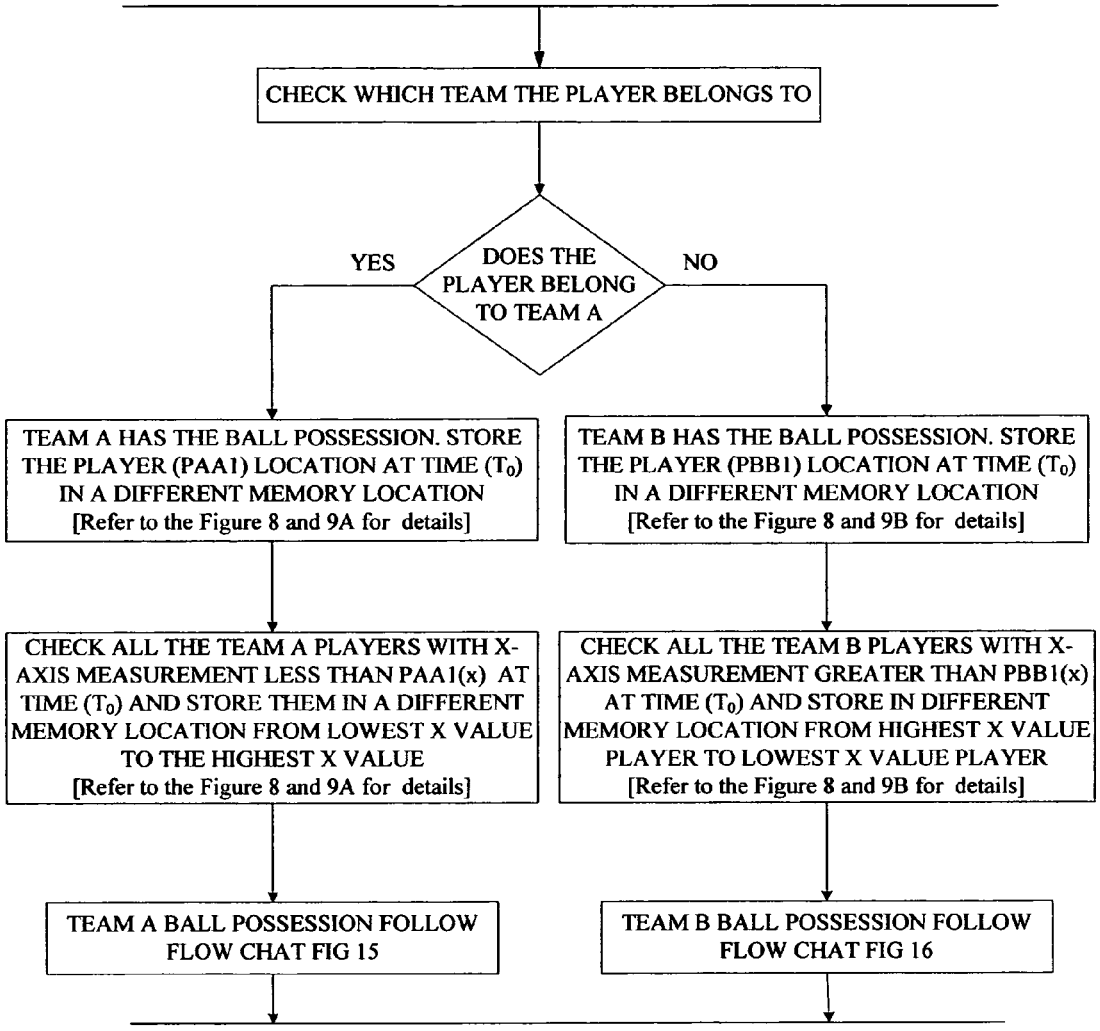

FIG 15: TEAM A BALL POSSESSION
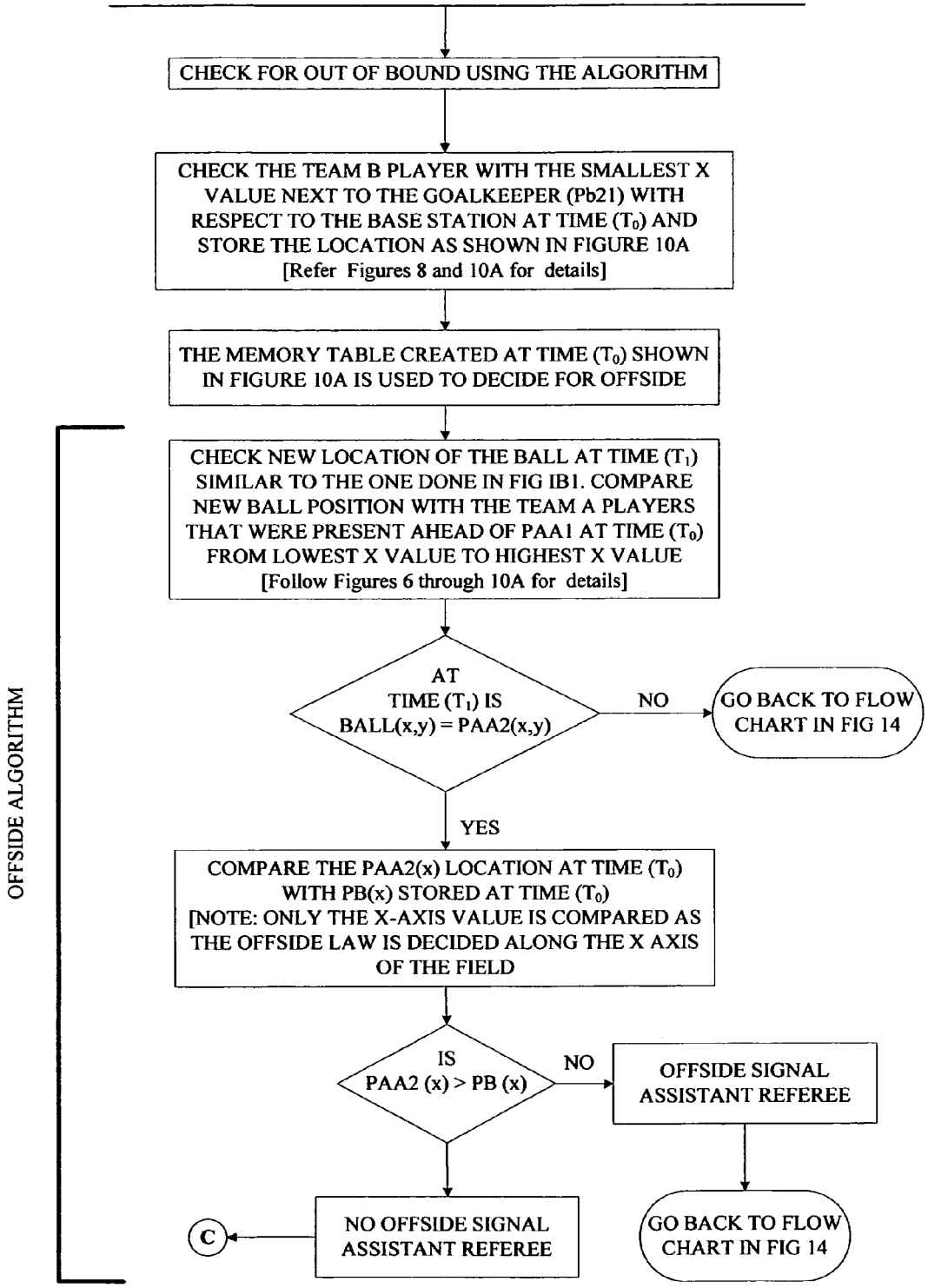

FIG 16: TEAM B BALL POSSESSION
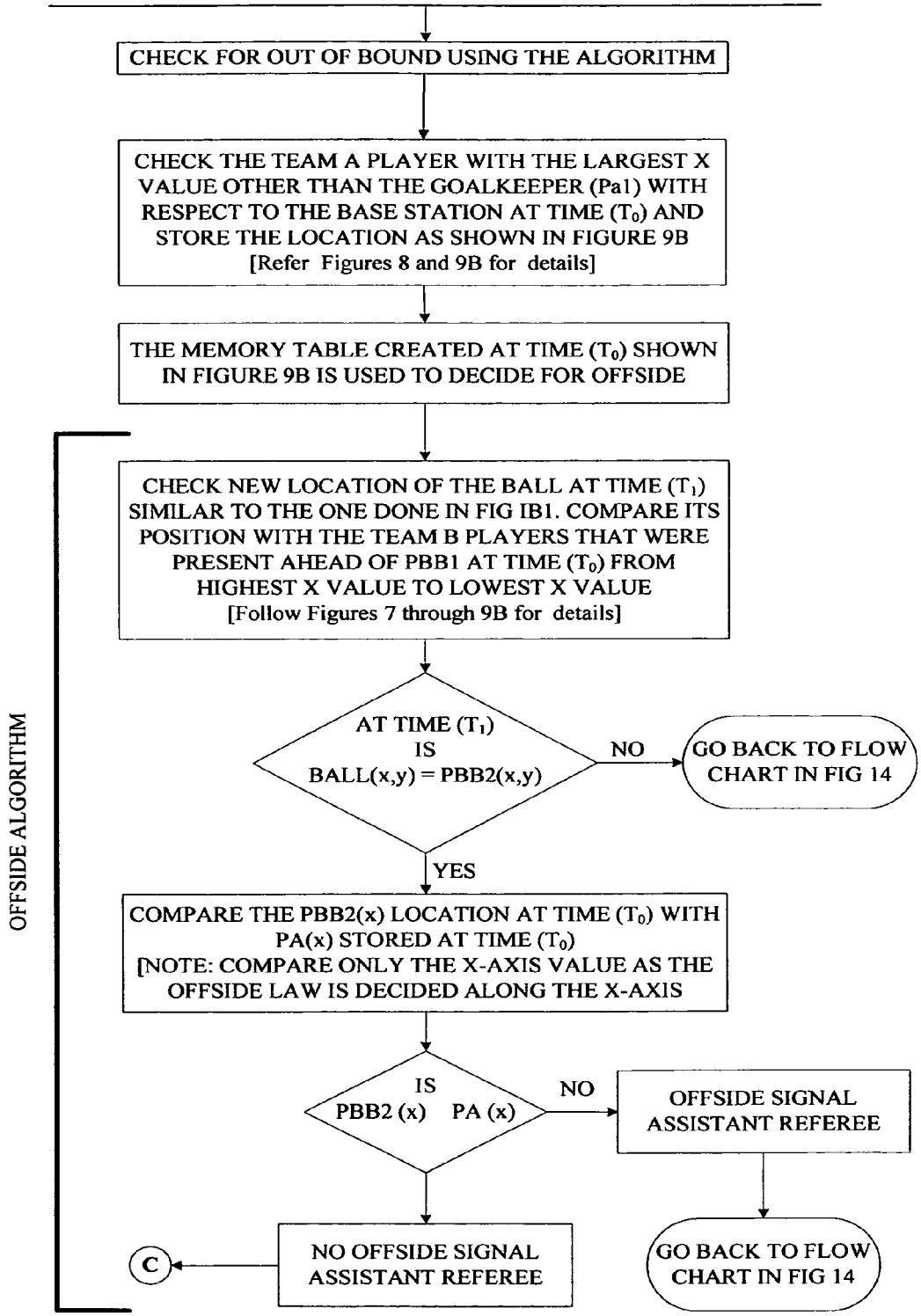

FIG.17: TEAM B ON THE LEFT
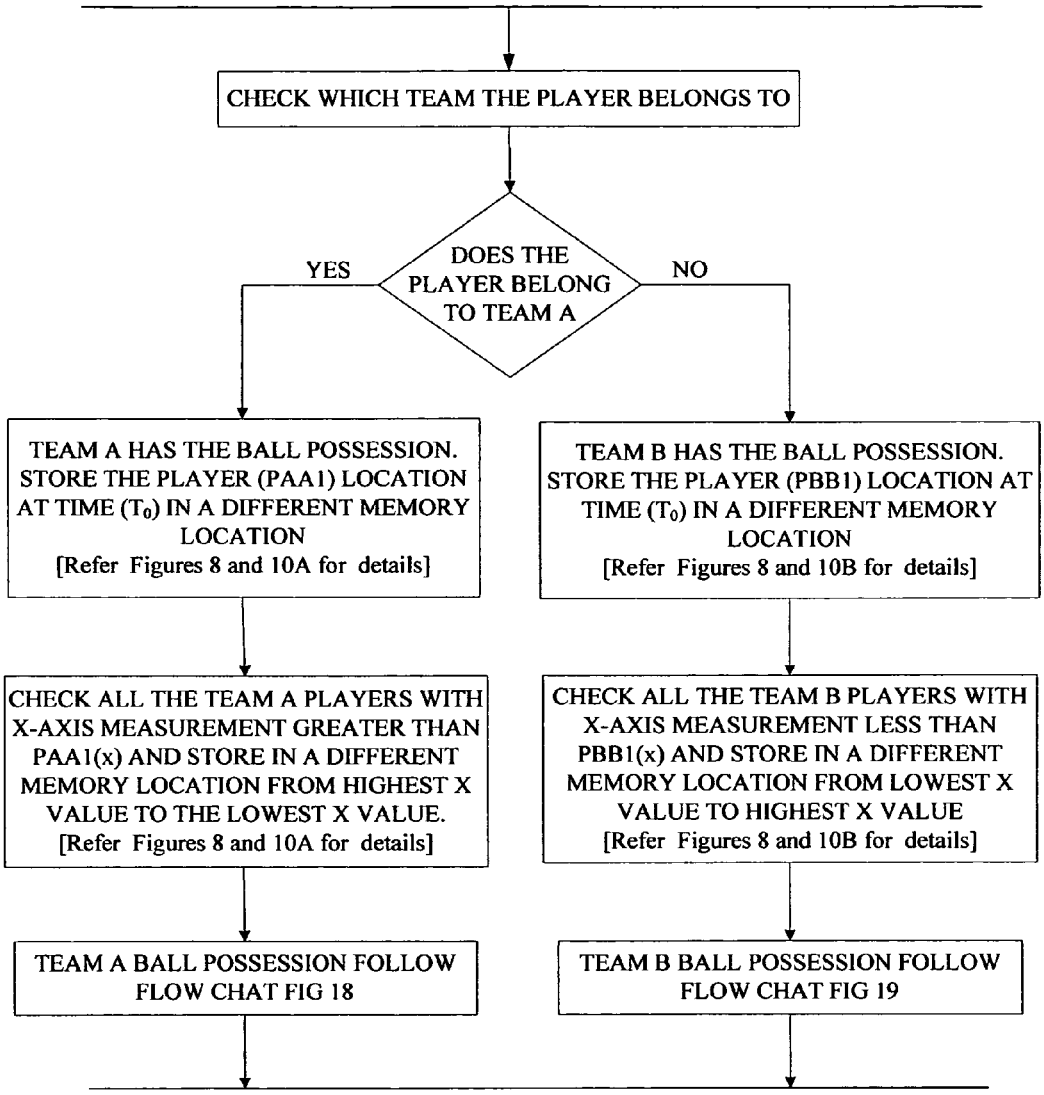

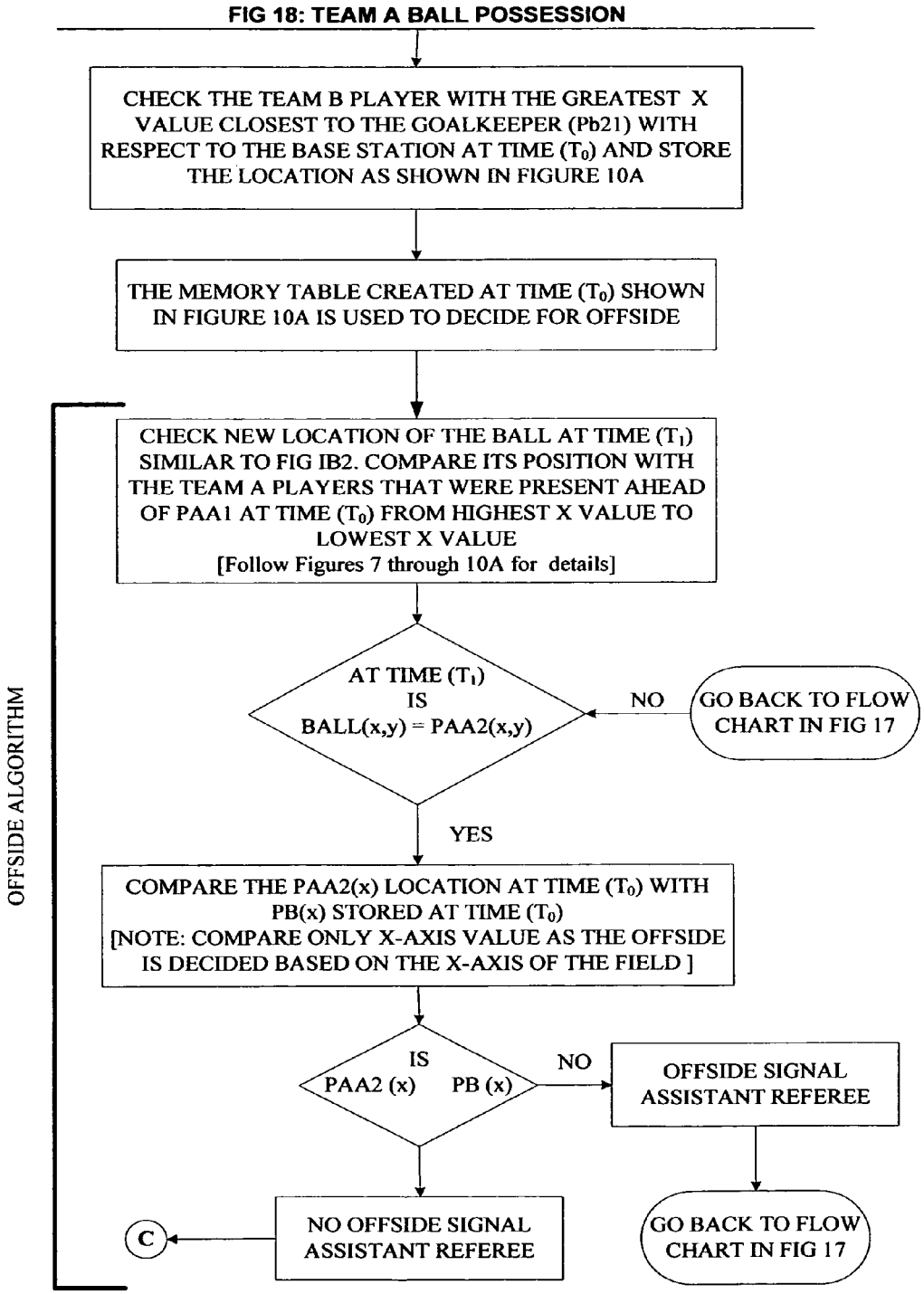
FIG 18: TEAM A BALL POSSESSION
CHECK THE TEAM B PLAYER WITH THE GREATEST X VALUE CLOSEST TO THE GOALKEEPER (Pb21) WITH RESPECT TO THE BASE STATION AT TIME ($T_0$) AND STORE THE LOCATION AS SHOWN IN FIGURE 10A
THE MEMORY TABLE CREATED AT TIME ($T_0$) SHOWN IN FIGURE 10A IS USED TO DECIDE FOR OFFSIDE
CHECK NEW LOCATION OF THE BALL AT TIME ($T_1$) SIMILAR TO FIG IB2. COMPARE ITS POSITION WITH THE TEAM A PLAYERS THAT WERE PRESENT AHEAD OF PAA1 AT TIME ($T_0$) FROM HIGHEST X VALUE TO LOWEST X VALUE
[Follow Figures 7 through 10A for details]
AT TIME ($T_1$) IS BALL(x,y) = PAA2(x,y)
NO
GO BACK TO FLOW CHART IN FIG 17
YES
COMPARE THE PAA2(x) LOCATION AT TIME ($T_0$) WITH PB(x) STORED AT TIME ($T_0$)
[NOTE: COMPARE ONLY X-AXIS VALUE AS THE OFFSIDE IS DECIDED BASED ON THE X-AXIS OF THE FIELD ]
IS PAA2 (x) PB (x)
NO
OFFSIDE SIGNAL ASSISTANT REFEREE
GO BACK TO FLOW CHART IN FIG 17
NO OFFSIDE SIGNAL ASSISTANT REFEREE
C
OFFSIDE ALGORITHM FIG 19: TEAM B BALL POSSESSION
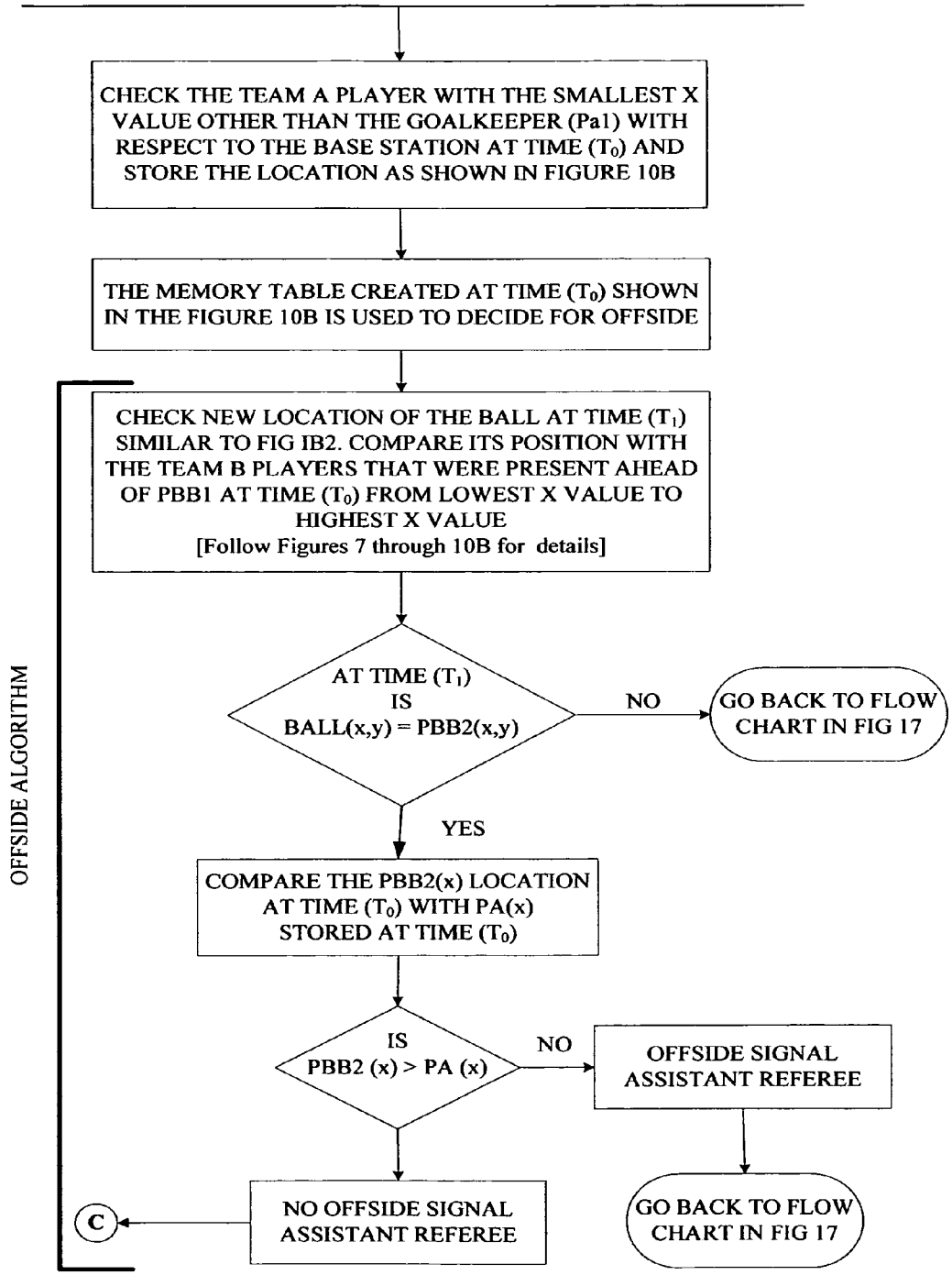

REALTIME COACHING SYSTEM

This invention relates to a real time athletic coaching and video game designing system employing a programmed computer and RFID technology.

BACKGROUND OF INVENTION

Due to limited observational capabilities coaches for games like soccer, basketball, American football, lacrosse and ice hockey often have difficulty accurately monitoring designed plays and game plans during actual performance of the players on the field of play. The speed with which the games are played, the number of players involved, the size of the playing field and the complex interactions of the players and equipment involved all contribute to the difficulties. In addition to tracking what is transpiring on the field, coaches have responsibility for monitoring and recording the academic or professional development of individual players. Under present conditions coaches are often forced to concentrate on the results of their strategies and efforts without knowing exactly why and how they are actually working or how individual players are actually performing.

The present invention assists the coach to carry out his responsibilities more effectively and accurately. For example, in the game of soccer, it employs a computer programmed with algorithms that detect key events like out of bounds, offside, and goals and records each player's performance during the game play. No operative method or system is known that assists coaches to determine effectiveness of a designed play or game plan in real-time while the players are practicing or performing on the field.

The patent literature contains several examples of similar but different systems using similar technology. U.S. Pat. No. 7,095,312 discloses a method and apparatus for tracking sports objects on an athletic field but obtains location information from a GPS system. U.S. Pat. No. 6,071,002 discloses a system employing video images as opposed to location information to assist coaches to detect and react to offensive and defensive patterns employed on an athletic field during a game. It does not disclose the apparatus or computer programming employed in the present invention. U.S. Pat. No. 7,005,970 discloses a method for assisting game officials to officiate athletic events. In one embodiment it employs RF based tracking equipment to locate players and game equipment on a playing field but it does not disclose the apparatus or computer software employed in the present invention or their use in coaching athletes or designing video games.

BRIEF SUMMARY OF INVENTION

Disclosure of Invention

The present invention employs core software with distinct algorithms to locate the players and the ball or puck on the training field, detect key events taking place during a game, and analyze the information in order both to check the effectiveness of the game plays designed by the coach and to generate vital statistics for each player. It can be used in real time during practice sessions and actual games as well as a tool for recording game plays for future reference. It can also be used to provide information about actual plays in real games to game designers to help them design more realistic and more interesting games.

Radio Frequency Identification (RFID) hardware is utilized in the preferred embodiment of the invention to monitor and communicate the location of the players and the game equipment like the ball or puck on the playing field with respect to a base station connected to a computer. The core software program in the computer processes all of the information while it is taking place on the field of play.

The key to generating relevant information from the game play is to integrate the core software with the RFID hardware to accurately track the players and the ball or puck along two dimensions of the rectangular playing field, the dimensions being herein denominated as X and Y axes from a point of origin in a corner of the field.

The complete system is composed of two main components: RFID hardware to acquire the X and Y-axis distance measurements, and software employing algorithms necessary to process the information in real-time. The RFID hardware consists of two parts: transponders (specifically RFID tags), and a RFID Reader System that acts as a Base Station. The RFID tags are placed on the game equipment worn by the players and the ball or puck, and around the field to act as a reference for the software to create a virtual field. The software is placed on a Computer or Micro Controller that is linked to a RFID Reader System (Base Station).

The core system software is structured to follow the ball or puck movement during the game. The software interface displays the movement of the players in real-time on the computer screen. The software processes the ball or puck movement to generate vital statistics and information from each game play a coach chooses to monitor, for example, passes completed, team ball possession, players involved in each play, pace of players, saves by goalkeeper, goals attempted or scored, out of bounds, and offside. Coaches can design and store plays using the software interface and compare it with what is actually taking place in real-time on the field of play.

The data collected using the foregoing technology to assist coaches can also be used by game designers both to design new sports video games and to produce plug-in accessories for existing games. The system software employed to assist coaches can also be used to process and analyze recorded live game action and sequences from the field of play to create a suitable data format for designers. The video games and plug-in accessories produced thereby would be much more realistic and authentic and thereby provide game players with a realistic game and a nearly real-time playing experience.

The word "game" as used herein applies to any athletic endeavor employing a coach or game designer wherein the endeavor involves multiple players and game equipment on a rectangular playing field. Most especially, a game comprises soccer, football, ice hockey, basketball and lacrosse.

The phrase "game equipment" as used herein applies, to the extent pertinent to the game involved, to balls, pucks, and equipment such as sticks, shoes, skates, gloves, clothes, protective pads or helmets which may come in contact with balls or pucks or otherwise help the coach or game designer to monitor the actions of the players.

The phrase "pertinent game play" as used herein applies to any event that takes place on a field on which a game is played that a coach or game designer chooses to monitor comprising passes attempted and completed, goals attempted and scored, saves made by a goal tender, out of bounds, off-sides, icing, areas covered by each player and the like.

The phrase "key locations on the field" as used herein applies to corners, sidelines, end lines, center lines, blue or red lines and goal lines whenever present and relevant to the pertinent game play.

The word "field" as used herein means the playing surface used by a game of sports, such as a soccer field, a football field, a basketball court, an ice rink or a lacrosse field.

A person with ordinary skill in this art using the core software technology consisting of algorithms and hardware already individually available on the market with the hardware configurations and logic diagrams disclosed herein can practice this invention.

BRIEF DESCRIPTION OF THE DRAWINGS

FIG. 6 displays a soccer field showing the team players located on each end of the field.

Figure 1:
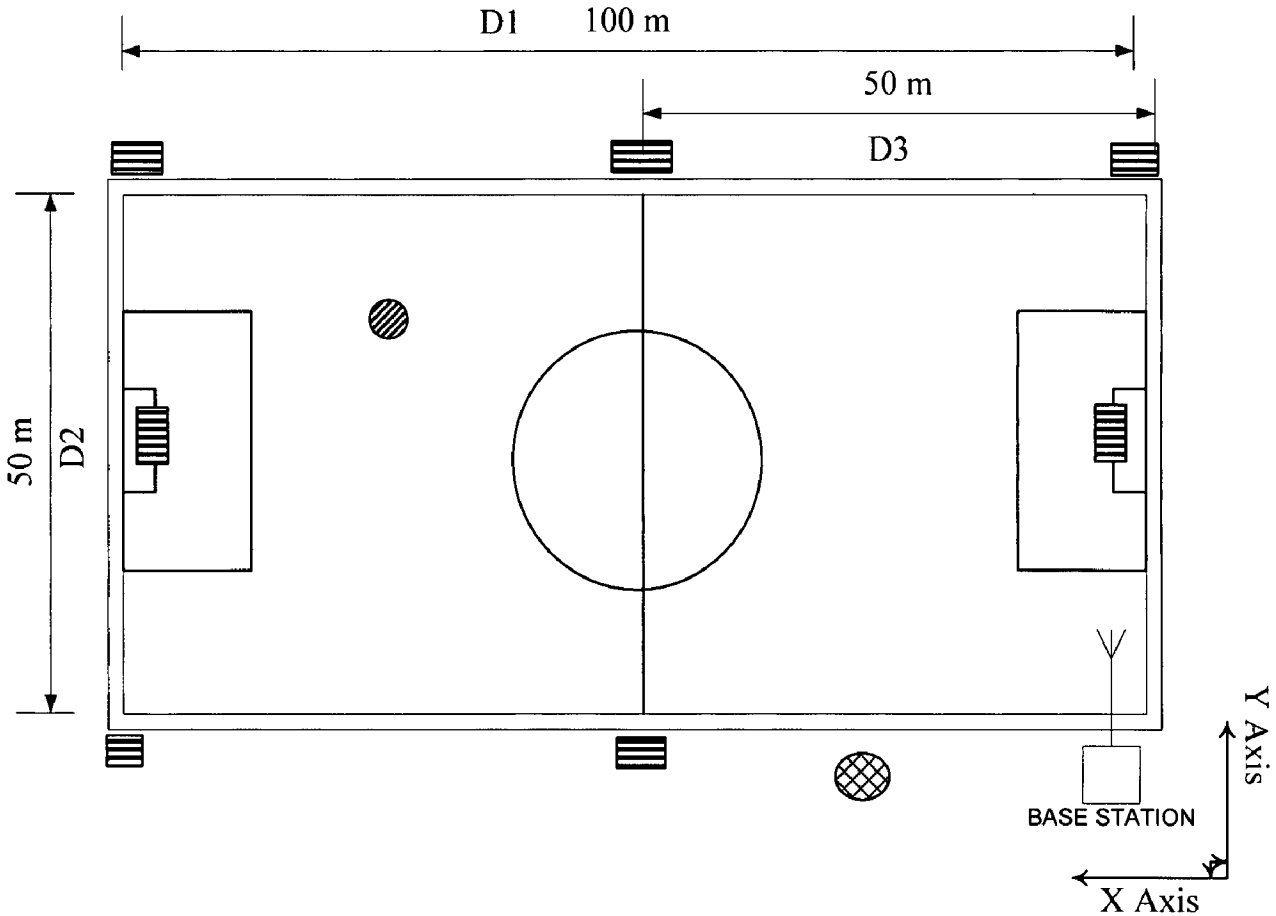
FIG. 1 is a diagram showing the basic system components on the playing field and the important distance markings needed for the software system.

More specifically, FIG. 13A describes the initial steps taken by the Core System Software during the start of the game.

FIG. 13B describes the "Out of Bound Algorithm" present in the Core System SoftWare. This algorithm detects whether the ball is outside of the playing field area.

FIG. 13C describes the "Least Distance Algorithm" and "Box Method Algorithm" to detect the player with the ball. The Core System Software uses both Algorithms to determine the player with the ball.

FIG. 13D describes steps within the Core System Software to detect the location of the teams on the playing field with respect to the center line marked on the field. This decision assists the software to decide logically how to proceed in order to decide on "Goal detection" and "Offside".

FIG. 13E describes the "Goal Detection Algorithm" present within the Core System Software. The "Goal Detection Algorithm" detects when a goal takes place on either end of the playing field.

FIG. 14 explains the logical steps taken by the Core System Software when "Team A" is on the left region with respect to the center line of the playing field. The logical flow assists the Software to make further decisions on how to proceed based on the Team that possesses the ball.

FIG. 15 describes the use of "Offside Algorithm" within the Core System Software when the "Team A" is on the left region of the playing field, and "Team A" possesses the ball. The software takes logical steps into consideration when the decision made in "FIG. 14" is "YES".

FIG. 16 describes the use of "Offside Algorithm" within the Core System Software when the "Team A" is on the left region of the playing field, and "Team B" possesses the ball. The software takes logical steps into consideration when the decision made in "FIG. 14" is "NO".

FIG. 17 explains the logical steps taken into consideration by the Core System Software when "Team B" is on the left region with respect to the center line of the playing field. The logical flow assists the Software to make further decisions on how to proceed based on the Team that possesses the ball.

FIG. 18 describes the use of "Offside Algorithm" within the Core System Software when the "Team B" is on the left region of the playing field, and "Team B" possesses the ball. The software takes logical steps into consideration when the decision made in "FIG. 17" is "YES".

FIG. 19 describes the use of "Offside Algorithm" within the Core System Software when the "Team B" is on the left region of the playing field, and "Team A" possesses the ball. The software takes logical steps into consideration when the decision made in "FIG. 17" is "NO".

DETAILED DESCRIPTION OF THE INVENTION

Best Mode for Carrying Out the Invention

The best mode contemplated for practicing the present invention is illustrated using the game of soccer (or football as it is known outside the U.S.) on the field on which it is played. The RF based hardware system used is a Radio Frequency Identification (RFID) system that acquires the X and Y distance measurement of the players and the ball. The distance information is processed by the software both to check the effectiveness of the game play created by the coach and to record key statistics for each player involved. The software checks for key events that take place during the game to determine, for example, whether a play is offside, out of bounds, or a goal. This is a nonstop process that runs continuously from the beginning until the end of the game. The core software can also be modified for American football, ice hockey, lacrosse and basketball.

FIG. 1 shows a typical soccer field 1 including boundaries 2*a*, 2*b* (sidelines) and 3*a*, 3*b* (end lines), the goals 4*a*, 4*b*, the referees 5 (referee), and 6 (coach) as they would normally be located on a training field; RFID hardware system setup is also shown with the location of the RFID Reference Tags 7*a*, 7*b*, 7*c*, 7*d*, 7*e*, 7*f*, 7*g* and the RFID Reader System that acts as the Base Station 8. The X and Y axes in relation to the Base Station is also illustrated. The X coordinate is the distance measurement of a player from the point of origin near the Base Station along a sideline boundary of the field. The Y coordinate is the distance measurement of a player from point of origin near the Base Station along the end line boundary of the field. The combination of an X coordinate and a Y coordinate uniquely identifies the location of each player and the ball on the field at any given time during the game.

Figure 2:
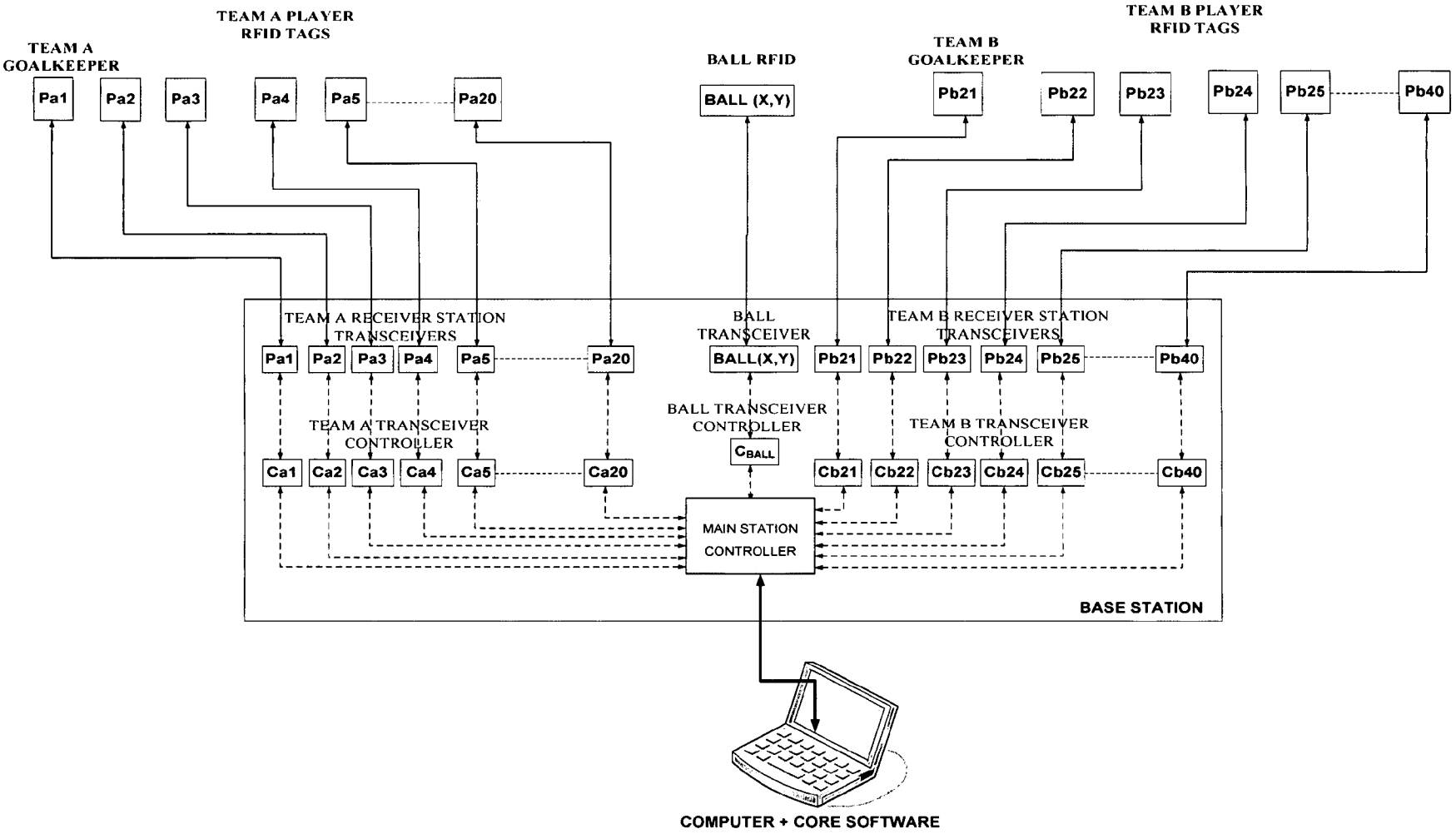
FIG. 2 is a block diagram of the complete RFID hardware system showing the RFID tags of the player and the ball, their communication link with the base station, and the main computer.

FIG. 2 shows the entire RFID hardware system setup including individual RFID Tags of the players and the ball, their communication link to the transceivers present in the RFID Reader or Base Station, and finally the communication link between the Base Station and the computer.

The complete system consists of four main parts: Reference RFID tags, Player and Ball RFID Tags, Base Station, and Core System Software present in a Computer. Small RFID Tags are affixed to each player and the ball. The RFID Tags can be placed on the player's jersey or inside the shoe. The Ball RFID Tag is placed inside the ball at a location or in a manner, which does not create instability.

Figure 3:
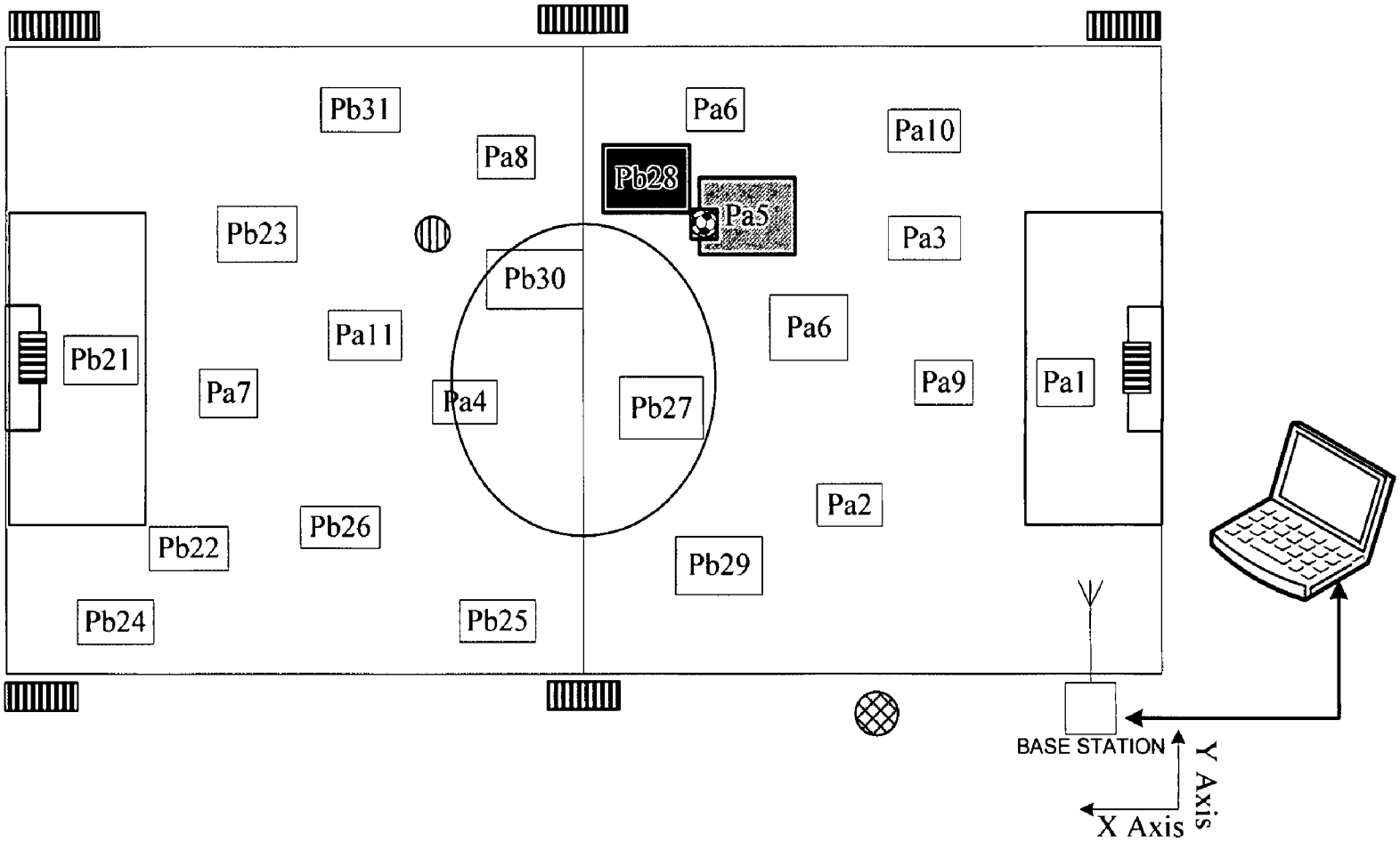
FIG. 3 is a diagram showing the respective team players and the ball or puck on the field linked to the base station, which is connected to the computer.

FIG. 3 shows the players present on the field as seen and recorded by the Core Software System. The team players on the field can be playing in a regular or practice game with the coach. The Base Station is connected to the Computer and placed on the edge of the field.

A number of important initial steps are taken to setup the hardware to ensure accurate assessment of what is taking place on the field of play. Some of the key steps involve placement of RFID Tags on the players and the ball, and placing Reference RFID Tags around the field to create a virtual playing field for the software.

To precisely locate players, the RFID Tags have to be small and light enough to be placed on either the shoes or the jersey of the players. If the RFID Tags are attached to the jersey, they can be placed inside the collar where the brand name of the jersey is displayed. By placing the Tags in this manner, a more accurate distance measurement can be made, since the upper half of player's body is more likely to lean forward, making him/her line up better with the ball (as seen from an aerial view). If the RFID Tags are small enough and can withstand a lot of pressure, they can be placed inside the sole of the shoe. In hockey and American football, the RFID Tags are placed on the protective pads. Any of the above setups can provide a very accurate X and Y-Axis measurement of the players for the software to process.

Figure 4:
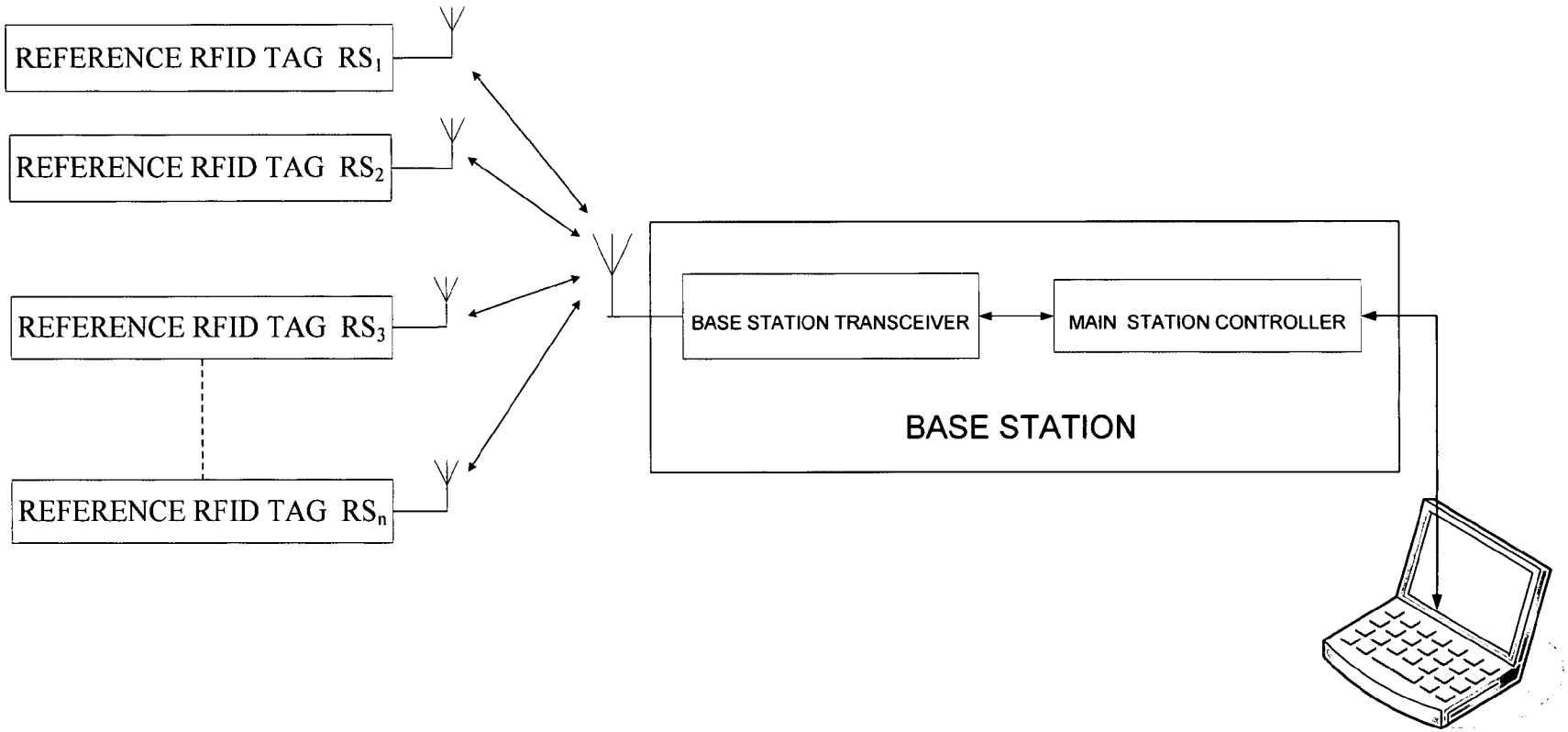
FIG. 4 is a block diagram showing how the base station communicates with the reference RFID tags placed around the key locations on the field.

FIG. 3 also shows a number of Reference RFID Tags fixed around the playing field at key locations such as corners, around boundaries, sidelines, end lines, and around the goals. The software uses the X and Y coordinates of these Reference RFID Tags to create a reference field in memory to make accurate decisions. These Reference measurements are constant thought-out the game and are utilized by the software algorithms to perform frequent checks for goals and out of bounds while making note of the players involved in each game play. FIG. 4 shows the communication link between the Reference RFID Tags and the Base Station.

The RFID Tags on the players and the ball communicate with the Base Station using specific frequencies within a particular frequency band. A frequency band is a group of adjacent radio frequencies assigned for transmitting radio signals. The RFID Reader (Base Station) and RFID Tags attached to the players and the ball work in a specific frequency band. The frequency band is selected within the band approved for such uses by the country in which the game is being played.

The main function of the Base Station is to calculate the X and Y distances of the players and the ball. The range of coverage of the RFID hardware depends both on the RFID Reader and the RFID Tags. For a practice game, the distance is usually small and the RFID Tags used for the players and the ball can work within a range of about 40-60 meters. For a complete regular game the RFID Tags must work in a range of about 90-100 meters to cover the complete field.

A short time interval, known as the System Time Interval, is used by the Base Station to update all the distance measurements of the players and the ball. In the software employed, initially, at time ($T_0$) the Base Station acquires all the distance measurements of the players and the ball. After the System Time Interval, at time ($T_1$), the Base Station updates the distance measurements and makes decisions by comparing the distance information of time $T_0$ and $T_1$ throughout the game. Depending on the RFID hardware employed, the System Time Interval can range from nanoseconds to a couple of seconds.

The Core System Software monitors the players and the ball during a complete practice session, and processes the information in real-time to create useful statistics for the coach. The software is downloaded onto the computer that is connected to Base Station as shown in FIG. 4.

In the software employed the RFID tags of the players from Team A and Team B are labeled as PAn and PBn, where 'n' represents the number assigned to each player. As shown in FIG. 3 the range of 'n' values extends from 1 to 20 for the Team A players and 21 to 40 for Team B players. The numerals of 1 and 21 for 'n' are assigned to Team A and Team B goalkeepers respectfully. Numerals '41' and above are assigned to the Ball RFID Tag and to the Reference RFID tags present around the field.

FIGS. 5 through 10 are used to describe the software architecture. FIG. 11 shows the complete System Software architecture with each flowchart labeled in the respective manner they appear. The System Software performs two main functions. First, the software stores the X and Y-axis measurements of all the players and the ball in proper order starting from the Team A players, then to Team B players, and the ball. Second, the software algorithms process the information by checking for key events as requested by the coach, such as out of bounds, goals, offside, passes completed, team ball possessions, players involved and their disposition in each play, area covered by each player, shots on goal, saves by goalkeeper and the part played in the foregoing by each player.

Figure 5:
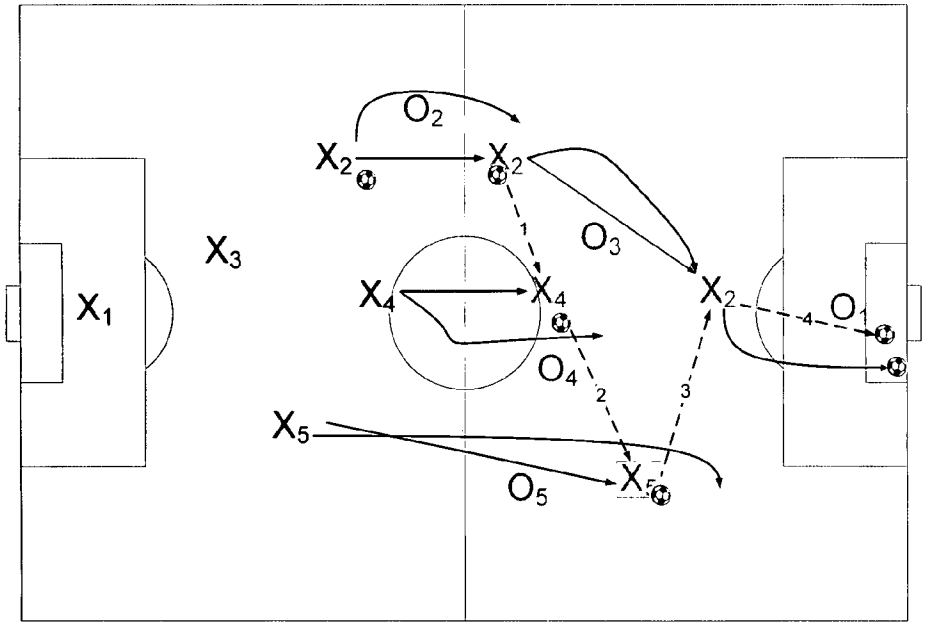
FIG. 5 is a sample graphical view of the software showing the coaches play on the left with general description of the game play, and the list of players on the right with game statistics.

FIG. 5 shows a graphical view created by the software as seen on a computer screen. The field is shown of the top left; on the right side of the field is the list of players that are involved in the game; and the bottom left section is the list of game plays that were created. The field view shows both the original play designed by the coach and the real-time play-taking place in on the field.

The original play designed by the coach is shown in black—the solid black arrows showing how the players should move during the game play and the dashed black lines for the ball movement during the play. The red lines show the actual live game movement of the players and the ball during the training session. The software visually shows the play together with statistics generated for each player on the right table.

Figure 7:
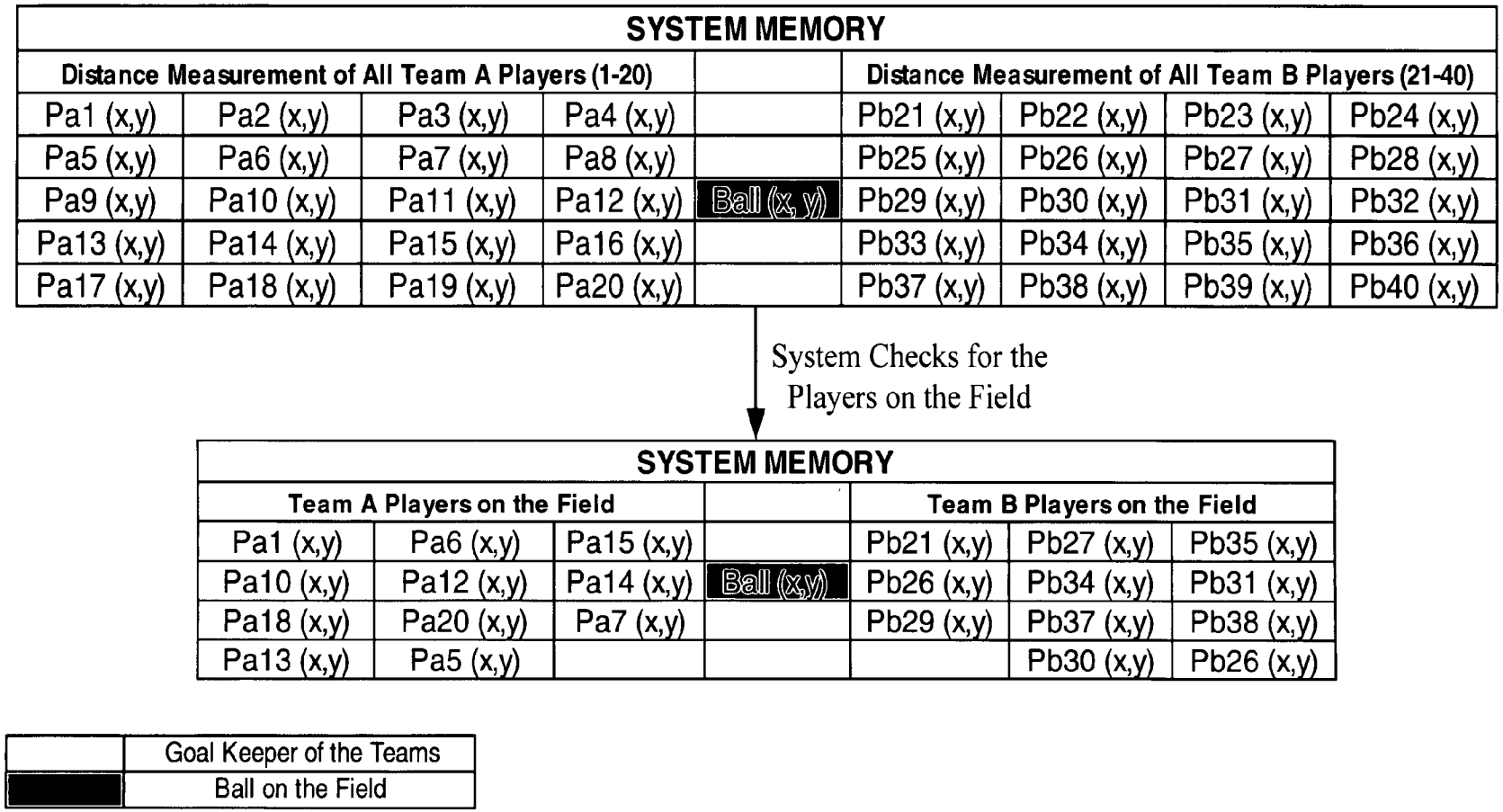
FIG. 7 illustrates a memory table including the stored information reflecting the locations of the players and the ball on the field.
Figure 8A:
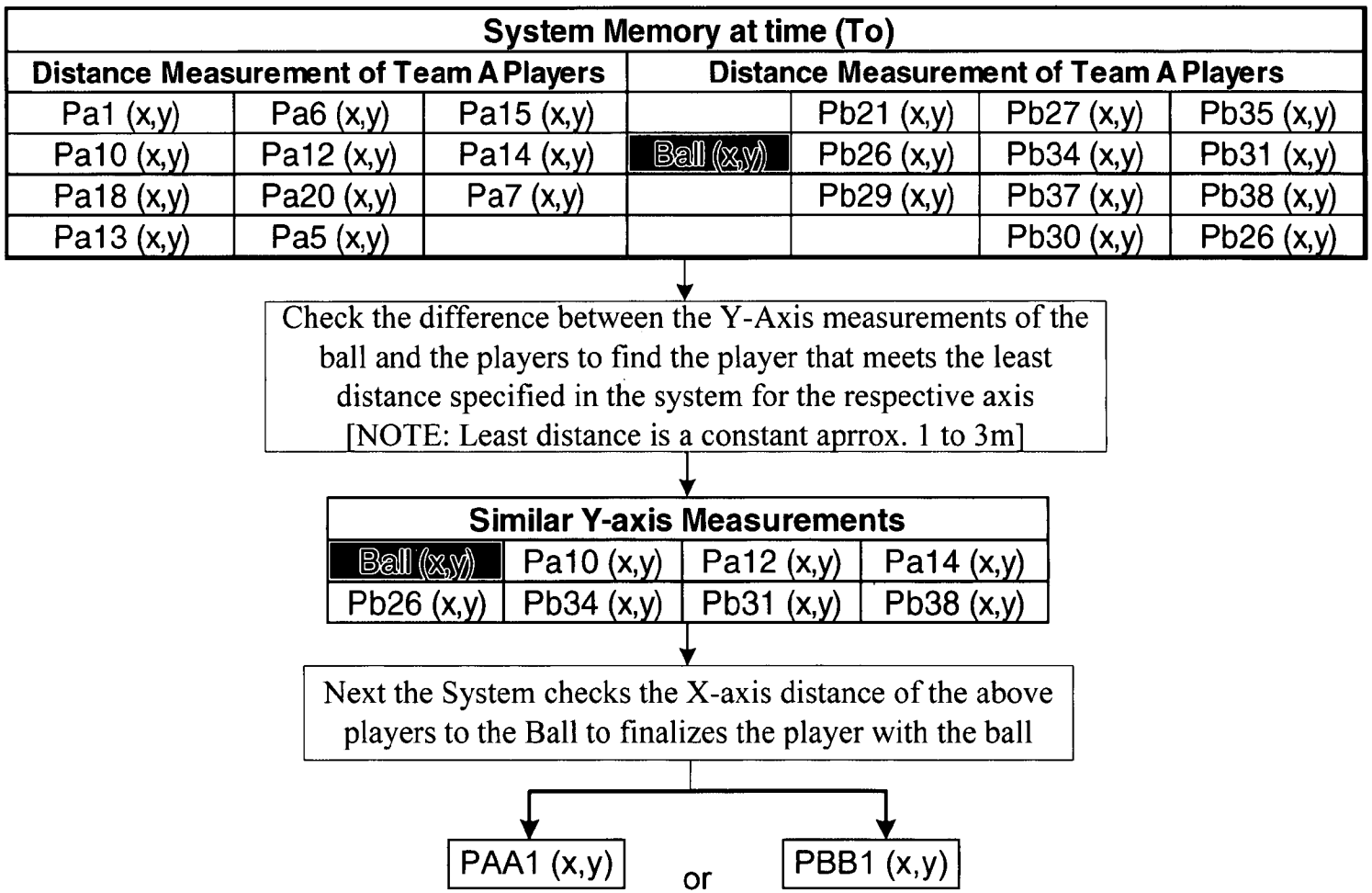
FIG. 8A illustrates the least distance method used by the system to check for the player with the ball or puck.
Figure 8B:
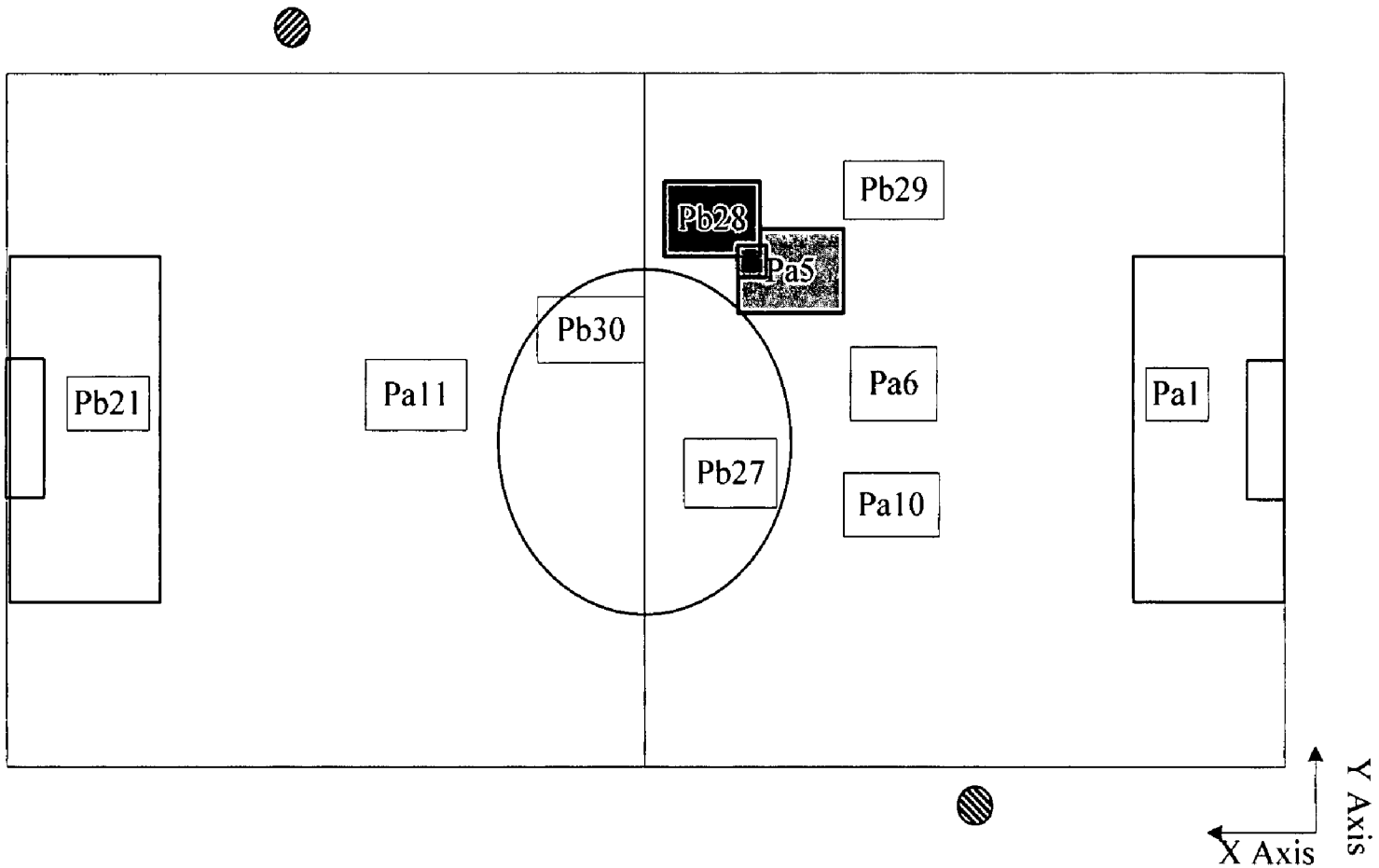
FIG. 8B illustrates the box method used by the system to check for the player if the least distance method does not find the player with the ball or puck.
Figure 9:
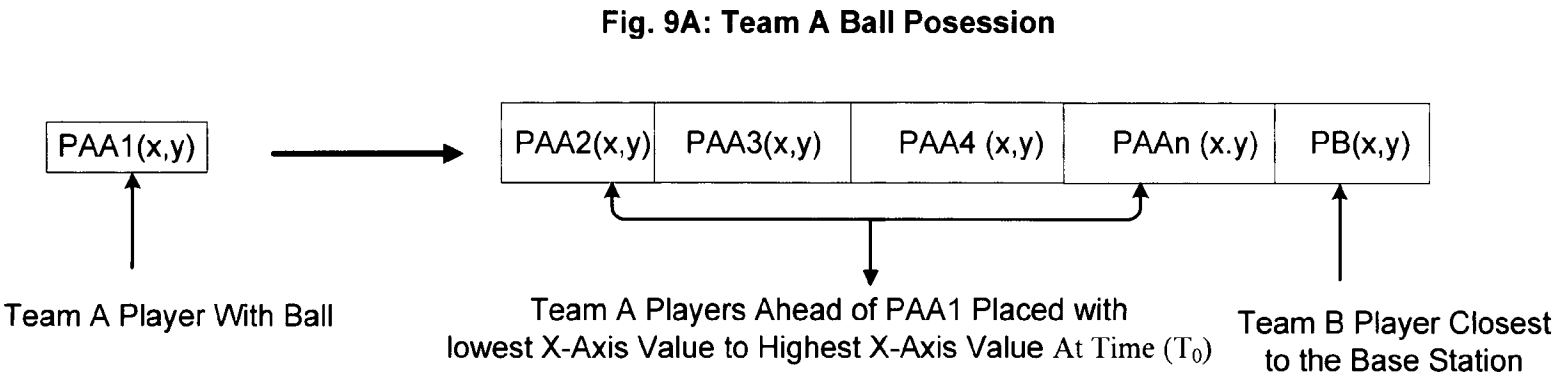
FIG. 9 illustrates the key players that are used by the system to check for offside when Team A. is on the left side of the field.
Figure 9:
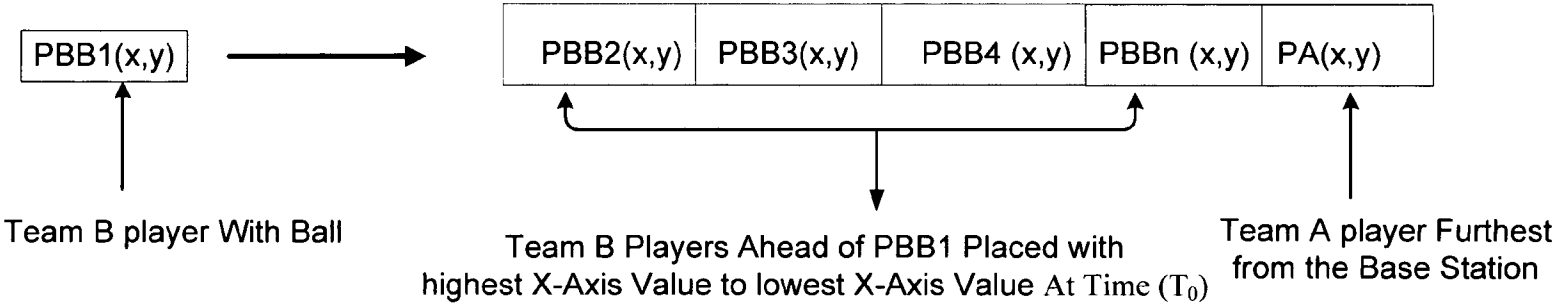
Figure 10:
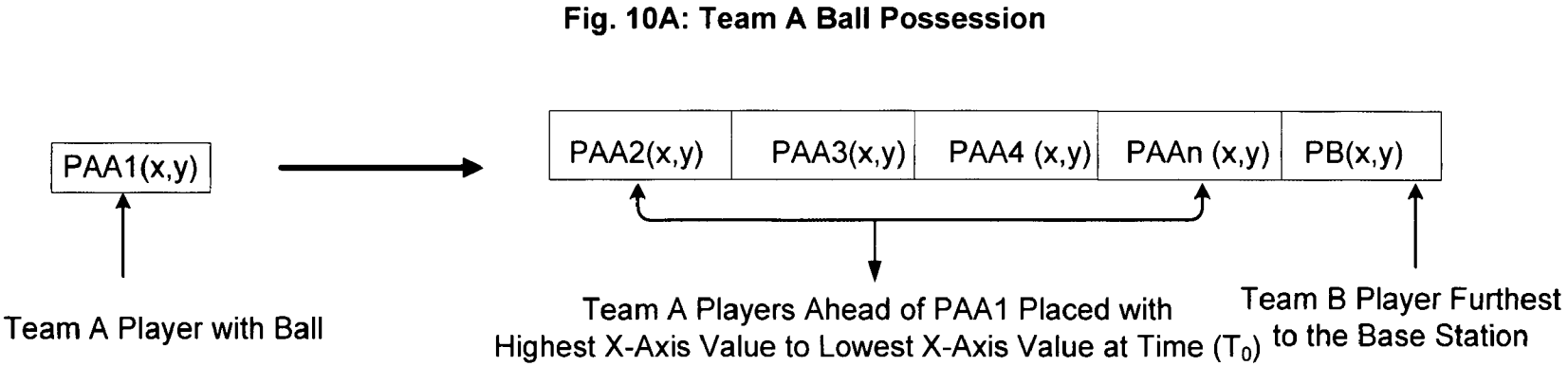
FIG. 10 illustrates the key players that are used by the system to check for offside when Team B is on the left side of the field.
Figure 10:
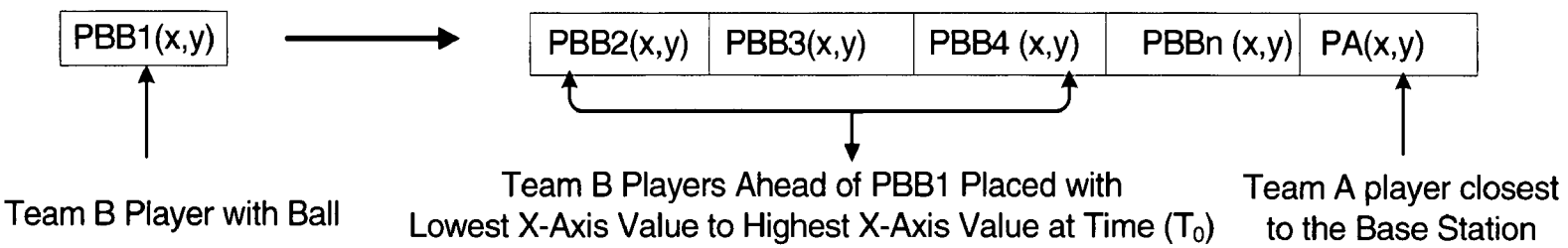
Figure 11:
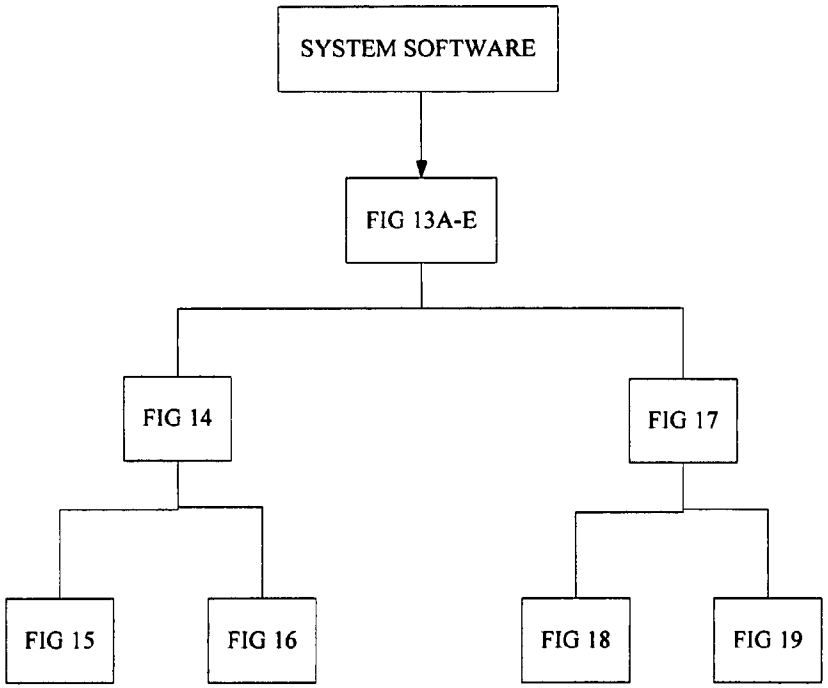
FIG. 11 shows a general outline of the software architecture with each block representing a figure with instructions.

FIG. 6 through FIG. 10 are reference figures that visually show information processed by the System Software. FIG. 6 shows a snap shot of the field as seen by the System Software at a certain time interval. The distances are measured along the X and Y-axes with the Base Station is kept as the starting point (0, 0). The location of the Base Station is considered as the right side of the field. Xmax and Ymax positions on the field are the maximum values for X and Y coordinates respectively. Distance 'D3' is measured from the center of the field to the base station for use by the software. FIG. 7 shows the data collected in the respective order from the field. FIG. 8 through FIG. 10 shows the process taken to find the player with the ball.

The complete System Software architecture consists of algorithms that assist in creating statistics for each player by detecting predefined scenarios such as out of bounds, goal, and offside during the game. The key algorithms in the System Software are—Team Location for locating where the teams are on the field, Least Distance, and Box Method to find the player with the ball, Out of Bounds to check the ball when it goes out of the field, Offside to test offside, and Goal Detection to detect when the ball passes the goal line.

Figure 12:
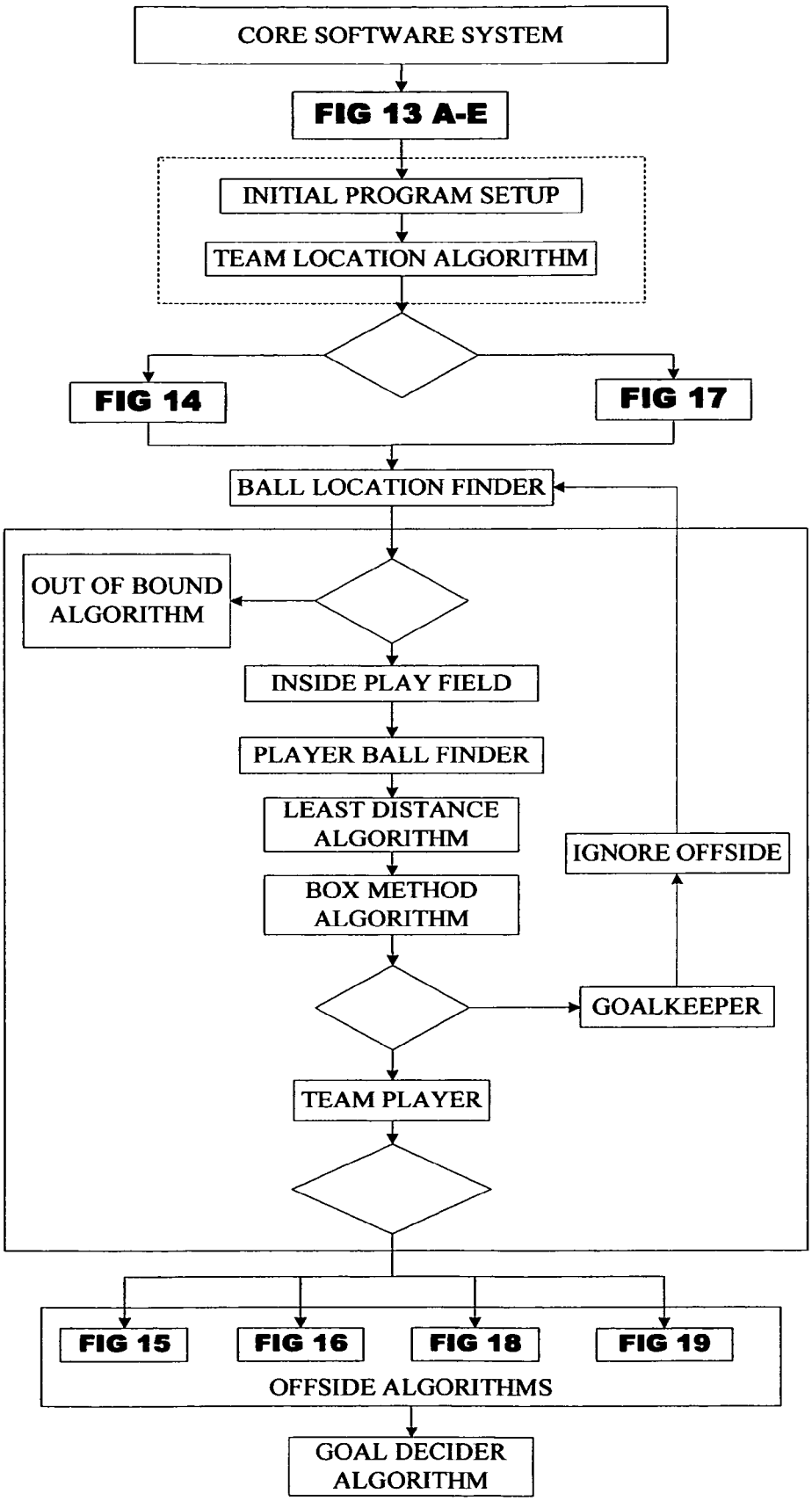
FIG. 12 provides a complete software flow chart and identifies the subsequent figures, which detail the software logic and algorithms employed to follow the game of soccer, and to detect pertinent game events such as out of bounds, offside, and goals.

FIG. 12 ET seq. shows an overview of the software with each algorithm present in the core software. To accurately locate the position and movement of the players and the ball, two unique algorithms, Least Distance and Box Method, are utilized.

The Least Distance algorithm is used to check for the player with the ball. The algorithm first records the location of the all the players and the ball. Then the algorithm calculates and stores the absolute value of the difference between the X-Axis value of the ball and X-Axis value of each player. Next, using the difference value, the algorithm selects only the players with a difference less than or equal to 1 m (Least Distance). This initial screening narrows down the players by selecting players closest along the X-Axis. Finally, the algorithm checks the Y-Axis value of the ball with the players that passed the first screening, to narrow down and find the player with the ball. This in turn helps to finalize which team possesses the ball. The Least Distance value depends on hardware performance and can be set to a value between 0.1 m to 1 m.

The Box Method technique is used to check for ball movement during the game. In the Box Method technique, the algorithm has pre-stored information on the maximum distance a player or the ball can move in any direction from a fixed position. The algorithm utilizes pre-stored distance information and the current position to create a virtual box around the players and the ball to store in memory. The diameter of the ball is stored in the memory as the maximum distance the ball can move to create the ball box. The maximum distance a player can move is an average physical dimension stored in memory based on foot movement. As shown in FIG. 8B, by comparing the Ball-Box with the Player-Boxes the system determines which player has the ball.

The foregoing information obtained from by placement of RFID tags on players, game equipment and the field can be used to record and store the game plays carried out on the field for use in designing sport gaming devices like video games and accessories to such games. The game plays and overall data file format can even be communicated to an electronic gaming device where sport-game software can be employed to create strategies against a game player. Most important, the recorded information can be used by game designers to produce more realistic and authentic electronic games and accessories. In summary the foregoing methodology can be employed in a method comprising placing RFID tags on players, game equipment and key locations on the playing field; using system software to process and analyze the data collected from the RFID tags during the actual play of the game to create a suitable data file format; and using the data file format to design and develop either new sport video games with improved fidelity and authenticity or plug-in accessories for existing sport video games to add realism by adjusting for player statistics and capabilities on a nearly real-time basis.

The present invention is designed to both improve team games like soccer, hockey, American football, basketball, and lacrosse as well as enhance the enjoyment of such games.

The foregoing provides both a general and specific description of the preferred embodiment of the invention. It should be understood that various substitutions, variations, and modifications can be made by those skilled in the art without departing from the spirit or scope of the invention as further delineated in the following claims.

The invention claimed is:

1. A method for increasing the effectiveness of an athletic coach's ability to monitor the activity taking place on a playing field in real-time during games comprising American foot ball, basketball, soccer, lacrosse or ice hockey involving multiple players and game equipment, the method comprising a) using distance information measured from a fixed location on the field to continuously locate the players and the game equipment, b) communicating the location information to a computer employing software comprising Team Location, Least Distance and Box Method algorithms to i. detect pertinent game plays, ii. monitor the movement of the players and game equipment and iii. thereby determine the effectiveness of the plays and game plan designed by the coach, c) generating key statistics of interest to a coach for each player, and d) displaying live movement of the players and game equipment and the detailed statistics for each player involved in the game on a screen.

2. A real-time coaching system to monitor players playing a game on a rectangular field to generate vital statistics for each player and to analyze the effectiveness of plays and game plans designed by a coach comprising a. RFID tags placed on key locations on the field to record field dimensions in software, b. RFID tags attached to each player and each piece of game equipment pertinent to the plays a coach wishes to monitor in playing the game, said RFID tags adapted to send out uniquely identifiable radio signals, c. an RFID reader to act as a Base Station off the field near a point of origin in a corner of the field to receive and monitor signals from the RFID tags of the players and game equipment, d. a computer programmed with Team Location, Least Distance, Box Method, and pertinent game play algorithms in the Base Station adapted to a) constantly acquire and analyze the positional information of the players and game equipment and thereby monitor players and game equipment movements continuously by detecting pertinent game plays during the game and b) record vital statistics comprising out of bounds, offside, passes attempted and completed, team ball possessions, players involved in each pertinent game play, disposition of each play, area covered by each player, pace of each player, saves by goalkeeper, and goals attempted and scored.

3. The method of using radio frequency technology and software to determine effectiveness of a coach's designed plays, strategy and overall game plan by monitoring movement of players and game equipment and determining when pertinent game plays occur in a game on a rectangular field of play having a center line, four corners, two longer parallel sides (one of which corresponds to an X-axis from a point of origin in a corner of the field), two shorter parallel sides (one of which corresponds to a Y-axis from the point of origin), blue and red lines (where pertinent) and two goal lines, which method comprises a) placing RFID tags on key locations on the field to create field dimensions in the software, b) equipping the players and game equipment employed in playing the game with RFID tags, said RFID tags adapted to send out uniquely identifiable radio signals, c) placing RFID reader equipment in a base station outside one of the side or end lines, said base station adapted to receive the unique signals from each player and piece of game equipment located on the field and measure X and Y coordinates of each such player and piece of equipment from the point e of origin, d) equipping the base station with a main controller or computer with system software comprising Team Location, Least Distance, Box Method, and pertinent game play detection algorithms to determine whether a pertinent game play has occurred using the distance information, e) processing player and game equipment movement while key events occur on the field to generate vital statistics comprising out of bounds, offside, passes completed, team ball or puck possessions, players involved and their disposition in each play, area covered by each player, pace of each player, icing where pertinent, saves by goalkeeper and goals attempted and scored, and f) using the foregoing information to determine the effectiveness of the players to carry out the plays and game plan designed by the coach.

4. The method of claim 3, wherein the system software is adapted to display the live movement of players and the game equipment visually onto a video screen or a website with constant automatic updates.

5. The method of designing and developing new sport video games and plug-in accessories for existing sport video games by collecting data on actions taking place during the actual play of a game on a playing field, the method comprising a) placing RFID tags on key locations on the field to record field dimensions in software, b) attaching RFID tags to each player and each piece of game equipment pertinent to the plays a game designer wishes to monitor in playing the game wherein the RFID tags are adapted to send out uniquely identifiable radio signals, c) employing an RFID reader to act as a base station off the field near a point of origin in a corner of the field to receive and monitor signals from the RFID tags of the players and game equipment, d) programming a computer in the Base Station with Team Location, Least Distance, Box Method and pertinent game play algorithms to constantly acquire and analyze the positional information of the players and game equipment and thereby monitor players and game equipment movements continuously by detecting pertinent game plays during the actual play of the game, and thereby create a suitable data file format and e) using the data file format installed in a computer to design and develop either new sport video games or plug-in accessories for existing sport video games and thereby improve fidelity, authenticity and realism by adjusting for player statistics and capabilities on a nearly real-time basis.

* * * * *